US008701437B2

(12) United States Patent
Choi

(10) Patent No.: US 8,701,437 B2
(45) Date of Patent: Apr. 22, 2014

(54) HOT AND COLD WATER DISPENSER

(76) Inventor: Sang Pil Choi, Incheon (KR)

( * ) Notice: Subject to any disclaimer, the term of this patent is extended or adjusted under 35 U.S.C. 154(b) by 341 days.

(21) Appl. No.: 13/032,027

(22) Filed: Feb. 22, 2011

(65) Prior Publication Data

US 2011/0203306 A1 Aug. 25, 2011

(30) Foreign Application Priority Data

| | | |
|---|---|---|
| Feb. 22, 2010 | (KR) | 10-2010-0015870 |
| Feb. 22, 2010 | (KR) | 10-2010-0015871 |
| Feb. 22, 2010 | (KR) | 10-2010-0015872 |
| Jul. 27, 2010 | (KR) | 10-2010-0072224 |
| Jul. 27, 2010 | (KR) | 10-2010-0072544 |
| Sep. 14, 2010 | (KR) | 10-2010-0090215 |
| Dec. 14, 2010 | (KR) | 10-2010-0127466 |
| Jan. 28, 2011 | (KR) | 10-2011-0008979 |

(51) Int. Cl.
*F25D 3/00* (2006.01)

(52) U.S. Cl.
USPC ..... 62/389; 62/443

(58) Field of Classification Search
USPC ..... 62/389, 386, 393, 399, 443; 222/145.1, 222/146.1, 146.6, 190
See application file for complete search history.

(56) References Cited

U.S. PATENT DOCUMENTS

| | | | | |
|---|---|---|---|---|
| 2,750,756 | A * | 6/1956 | Canter | 62/181 |
| 3,333,438 | A * | 8/1967 | Benua et al. | 62/395 |
| 3,583,308 | A * | 6/1971 | Williams | 99/302 R |
| 3,791,284 | A * | 2/1974 | Donot | 99/289 R |
| 4,061,184 | A * | 12/1977 | Radcliffe | 165/286 |
| 4,600,148 | A * | 7/1986 | Raymer et al. | 239/29.3 |
| 4,641,012 | A * | 2/1987 | Roberts | 392/451 |
| 5,172,832 | A * | 12/1992 | Rodriquez et al. | 222/146.1 |
| 6,237,345 | B1 * | 5/2001 | Kalman et al. | 62/3.64 |
| 6,293,336 | B1 * | 9/2001 | Emerick et al. | 165/163 |
| 6,648,174 | B2 * | 11/2003 | Greene | 222/66 |
| 7,571,621 | B2 * | 8/2009 | Dietschi et al. | 62/434 |
| 7,810,551 | B2 * | 10/2010 | Ippoushi et al. | 165/104.28 |

* cited by examiner

*Primary Examiner* — Mohammad M Ali
(74) *Attorney, Agent, or Firm* — Harness, Dickey & Pierce, P.L.C.

(57) ABSTRACT

Disclosed therein is a hot and cold water dispenser, which includes cooling means or heating means for cooling or heating water. The hot and cold water dispenser includes: a feed pipe having a flow path formed therein for allowing a flow of water; and a temperature control pipe disposed inside or outside of the feed pipe along a longitudinal direction of the feed pipe, the temperature control pipe having a space for receiving the cooling means or the heating means therein to cool or heat water flowing through the feed pipe by means of the cooling means or the heating means.

13 Claims, 33 Drawing Sheets

HOT AND COLD WATER DISPENSER

CROSS REFERENCE TO RELATED APPLICATIONS

This application claims the benefit and priority of Patent Application Nos. KR 10-2010-0015871 filed Feb. 22, 2010; KR 10-2010-0015872 filed Feb. 22, 2010; KR 10-2010-0015870 filed Feb. 22, 2010; KR 10-2010-0072224 filed Jul. 27, 2010; KR 10-2010-0072544 filed Jul. 27, 2010; KR 10-2010-0090215 filed Sep. 14, 2010; KR 10-2010-0127466 filed Dec. 14, 2010 and KR 10-2011-0008979 filed Jan. 28, 2011. The entire disclosures of the above applications are incorporated herein by reference.

BACKGROUND OF THE INVENTION

1. Field of the Invention

The present invention relates to a hot and cold water dispenser, and more particularly, to a hot and cold water dispenser, which includes a feed pipe, a temperature control pipe formed integrally with the feed pipe to directly carry out heat exchange, and a cooling pipe disposed at the central portion of a cold water tank, thereby enhancing cooling efficiency or heating efficiency and effectively utilizing an installation space.

2. Background Art

In general, apparatuses for providing cold water or hot water are commonly called hot and cold water dispensers. Such hot and cold water dispensers may be divided in various ways according to their capacities or use conditions, but are equal in structure that they cool water using refrigerant and heat water using a heater to provide cold water or hot water necessary for daily life. Recently, as standards of living improve and technologies develop hot and cold water dispensers are being used not only in enterprises and government offices but also in houses.

A hot and cold water dispenser according to a prior art has a structure that a cooling pipe is wound on the outer circumference of a cylindrical cold water tank to cool the cold water tank. As an instance, Korean Utility Model Registration No. 20-0437839 discloses a hot and cold water dispenser.

In Korean Utility Model Registration No. 20-0437839, the hot and cold water dispenser includes a cooling pipe 12 spirally wound on the outer circumference of a cold water tank 11 several times. The hot and cold water dispenser according to the prior art has advantages in that a contact area between the cooling pipe 12 and the cold water tank 11 can be controlled by adjusting the length of the cooling pipe (the wound number of the cooling pipe) wound around the cold water tank, in that it can enhance a cooling efficiency by maximizing the contact area, and in that it is easy to install.

Moreover, the hot and cold water dispenser of the prior art includes a hot water tank having a heater therein, wherein the heater that generates heat by external power heats water introduced into the hot water tank.

However, the cold water tank of the prior art deteriorates the cooling efficiency because one side of the cooling pipe is in contact with the outer circumference of the cold water tank and the other side is exposed to the outside. Of course, because a heat insulator is disposed on the outer face of the cooling pipe, it can prevent that the cooling efficiency is deteriorated greatly, but some loss is inevitable. Furthermore, because the cooling pipe is disposed on the outer circumference of the cold water tank and the heat insulator is disposed on the cooling pipe to prevent deterioration of the cooling efficiency, the volume of the cold water tank increases. Additionally, because the cooling pipe is disposed on the outer circumference of the cold water tank, it may be directly exposed to the external shock during the manufacturing process or the installation process.

SUMMARY OF THE INVENTION

Accordingly, the present invention has been made to solve the above-mentioned problems occurring in the prior arts, and it is an object of the present invention to provide a hot and cold water dispenser, in which a cooling pipe where water flows and a temperature control pipe having cooling means or heating means are formed integrally with each other for cooling or heating a cold water tank, thereby enhancing cooling efficiency or heating efficiency by maximizing a contact area and minimizing the quantity of water to be heated per unit area of the temperature control pipe.

It is another object of the present invention to provide a hot and cold water dispenser, which has a cold water tank structure that includes the cooling pipe disposed inside a cold water tank, thereby enhancing cooling efficiency, reducing the volume of the cold water tank, and enhancing sealability and stability of the cooling pipe.

To accomplish the above object, according to the present invention, there is provided a hot and cold water dispenser, which includes cooling means or heating means for cooling or heating water, comprising: a feed pipe having a flow path formed therein for allowing a flow of water; and a temperature control pipe disposed inside or outside of the feed pipe along a longitudinal direction of the feed pipe, the temperature control pipe having a space for receiving the cooling means or the heating means therein to cool or heat water flowing through the feed pipe by means of the cooling means or the heating means.

The hot and cold water dispenser according to the present invention can minimize energy consumption and immediately provide cold water or hot water by a user's demand by enhancing cooling or heating efficiency. Moreover, the hot and cold water dispenser can minimize the volume of the cold water tank or the hot water tank and enhance sealability, so that the user can easily install it on a sink or a small water purifier.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
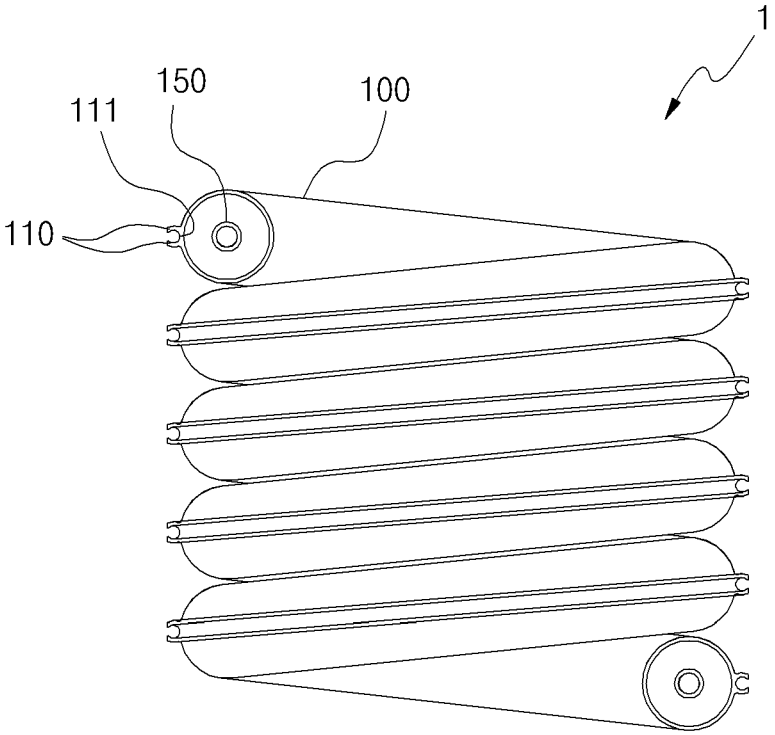
FIG. 1 is a view showing a structure of a cold water tank of a hot and cold water dispenser according to the present invention.
Figure 2:
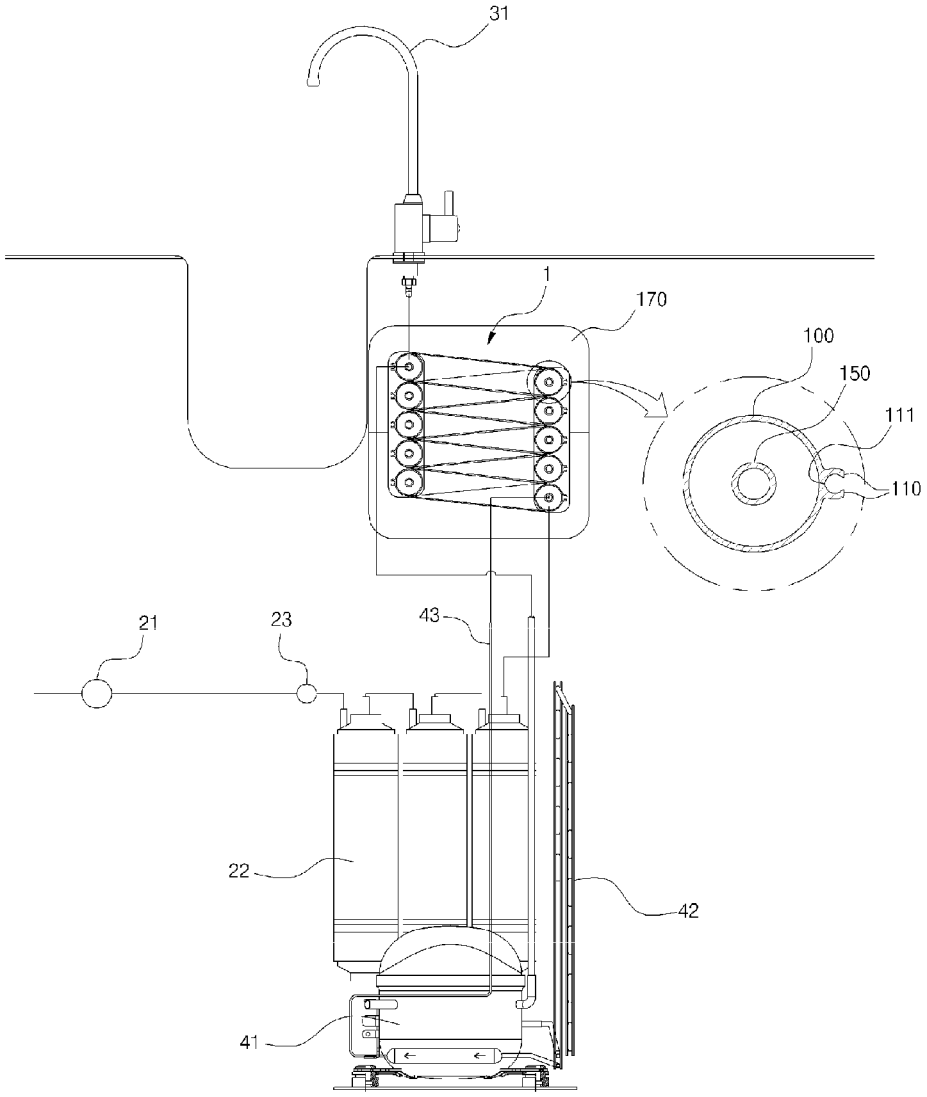
FIG. 2 is a schematic diagram of the hot and cold water dispenser having the cold water tank of FIG. 1.

FIG. 1 is a view showing a structure of a cold water tank of a hot and cold water dispenser according to the present invention, and FIG. 2 is a schematic diagram of the hot and cold water dispenser having the cold water tank of FIG. 1.

Referring to FIGS. 1 and 2, a hot and cold water pipe 1 of the hot and cold water dispenser according to the present invention includes a feed pipe 100 and a temperature control pipe 150.

The feed pipe 100 has a hollow part in which water flows. The feed pipe 100 or the hollow part may be circular or polygonal in cross section form, and preferably, is in a circular form.

The feed pipe 100 is in a coiled form that the feed pipe 100 is turned at least once, the coiled feed pipe 100 is combined with and lies upon another feed pipe 100, which is adjacent thereto, and hence, the feed pipes 100 have a layered structure in order to enhance space utilization and increase cooling efficiency or heating efficiency of the temperature control pipe 150, which will be described later. That is, the feed pipes 100 are in close contact with each other without forming any gap therebetween. The coiled feed pipes 100 are to show a preferred embodiment of the present invention, and the present invention is not restricted to the above. Accordingly, the feed pipes 100 may be arranged in various forms, for instance, in a linear form, in a layered form of plural straight lines, or in a form that straight lines and curved lines are combined according to structures or widths of installation spaces.

The temperature control pipe 150 is to cool or heat water flowing inside the feed pipe 100 by cooling means or heating means, which will be described later, and is arranged inside the feed pipe 100 in a longitudinal direction. Namely, the temperature control pipe 150 is disposed along the hollow part formed in the feed pipe 100, causes heat exchange with water, which flows along the inner length of the feed pipe, to thereby cool or heat the water flowing inside the feed pipe 100.

The temperature control pipe 150 is mounted not to be moved inside the feed pipe 100. For this, not shown in the drawings, but the temperature control pipe 150 arranged at the center of the feed pipe 100 is bent inside the feed pipe 100 and near an end portion of the feed pipe 100, and then, end portions of the temperature control pipe 150 that penetrates the feed pipe 100 are fixed to the feed pipe 100. The temperature control pipe 150 fixed inside the both end portions of the feed pipe 100 is supported by the bent portions and kept in a state where it is arranged at the internal center of the feed pipe 100 along the longitudinal direction of the feed pipe 100. Alternatively, not shown in the drawings, but the temperature control pipe 150 is bent inside the feed pipe 100, an end portion of the temperature control pipe 150 is exposed to the outside through an open end of the feed pipe 100 in close contact with the inner circumferential surface of the feed pipe 100, and the end portion of the temperature control pipe 150, which is in close contact with the inner circumferential surface of the feed pipe 100, is fixed to the feed pipe by one of various known methods, such as welding, and hence, the temperature control pipe 150 can be kept in the state where it is arranged at the internal center of the feed pipe along the longitudinal direction of the feed pipe 100. Further alternatively, connectors (not shown) are joined to end portions of the feed pipe 100 to keep a state where the temperature control pipe 150 is arranged in the internal center of the feed pipe 100. The method of fixing the temperature control pipe to the feed pipe using the connectors will be described later.

The feed pipe 100 and the temperature control pipe 150 are made of metal, and preferably, made of copper or an alloy of copper or aluminum or an alloy of aluminum with high thermal conductivity and corrosion resistance. Furthermore, it is preferable that the inner circumferential surfaces and the outer circumferential surfaces of the feed pipe 100 and the temperature control pipe 150 are treated by anodizing or coated with anti-corrosive paints or with anti-corrosive resin. The coating with anti-corrosive paints or anti-corrosive resin may be carried out by coating the inner circumferential surfaces and the outer circumferential surfaces of the feed pipe 100 and the temperature control pipe 150 with a material, such as epoxy or Teflon, having heat resistance and shock endurance. Additionally, the anodizing treatment is carried out to protect the inside of metal by making a thin oxide film on the surface of the metal, which makes the oxide film on the surface thereof because it has high reactivity to oxygen, such as aluminum, titanium, magnesium, or the like. The anodizing treatment makes the metal act as the anode in a specific solution such as sulfuric acid, promotes oxidation of the surface of the metal to thereby artificially generate a uniform thickness of an oxide film. As described above, the metals having high reactivity to oxygen can form the oxide film itself to protect the inside thereof, but they necessarily contain impurities, such as iron, silicon and copper, due to the high reactivity. If impurity content is high, intermetallics (hereinafter, called 'IMC'), such as $Al_3Fe$, $Al_6Fe$, $Al_5FeSi$, $Al_2Cu$, and so on, are generated between the impurities and the metal (hereinafter, called 'aluminum' as an example) while a product is manufactured using one of the metals, and the IMC cannot form the oxide film itself differently from aluminum. Here, when aluminum or an alloy of aluminum having a high impurity content is left in the air and is used as it is, a critical problem, for instance, stress concentration due to a hole or corrosion formed at a part where the IMC is generated, may occur. Therefore, anodizing applies the principle that if the IMC, which cannot form the oxide film in the air, is put in the specific solution, such as sulfuric acid, even the IMC can form the oxide film.

In the meantime, the feed pipe 100 includes seating ribs 110 that are formed on the outer circumferential surface thereof and has a seating groove 111 in a longitudinal direction, and a temperature sensor (not shown) is joined to the seating rib 110 to sense temperature of water, which flows inside the feed pipe 100. The seating ribs 110 may have any shape if the temperature sensor can be accommodated in the seating ribs 110, but preferably, has a circular shape whose one side is opened as shown in the drawings.

The feed pipe 100 having the above structure has an end portion connected to a water supply pipe 21 and the other end portion connected with a water outlet 31. In detail, a flow path of the feed pipe 100 is connected with the water supply pipe 21 and the water outlet 31. Accordingly, water introduced into the inner flow path of the feed pipe 100 from the water supply pipe fills the inner flow path of the feed pipe 100, and then, flows out through the water outlet 31 as the need arises.

In this instance, in order to purify water before the water supplied from the water supply pipe 21 is introduced into the feed pipe 100, a water purification filter 22 may be interposed between the water supply pipe 21 and the feed pipe 100. Moreover, a pressure reduction valve 23 may be disposed between the water supply pipe 21 and the water purification filter 22 to drop pressure of water supplied from the water supply pipe 21. Furthermore, a solenoid valve (not shown) may be disposed between the pressure reduction valve 23 and the water purification filter 22 to supply water to the water purification filter 22 to replenish the feed pipe 100 with water by opening the valve after a controller (not shown) detects the residual quantity of water inside the feed pipe 100. Of course, another solenoid valve (not shown) may be mounted between the water purification filter 22 and the feed pipe 100.

The solenoid valve (not shown) can be operated by combination of a pedal switch for opening and closing the water outlet 31 by a user's foot or a sensor for opening and closing the water outlet 31 by sensing the user's movement and the controller. Additionally, in the place of the solenoid valve, a check valve (not shown) for opening and closing the water outlet 31 manually may be mounted on the water outlet 31.

Figure 3:
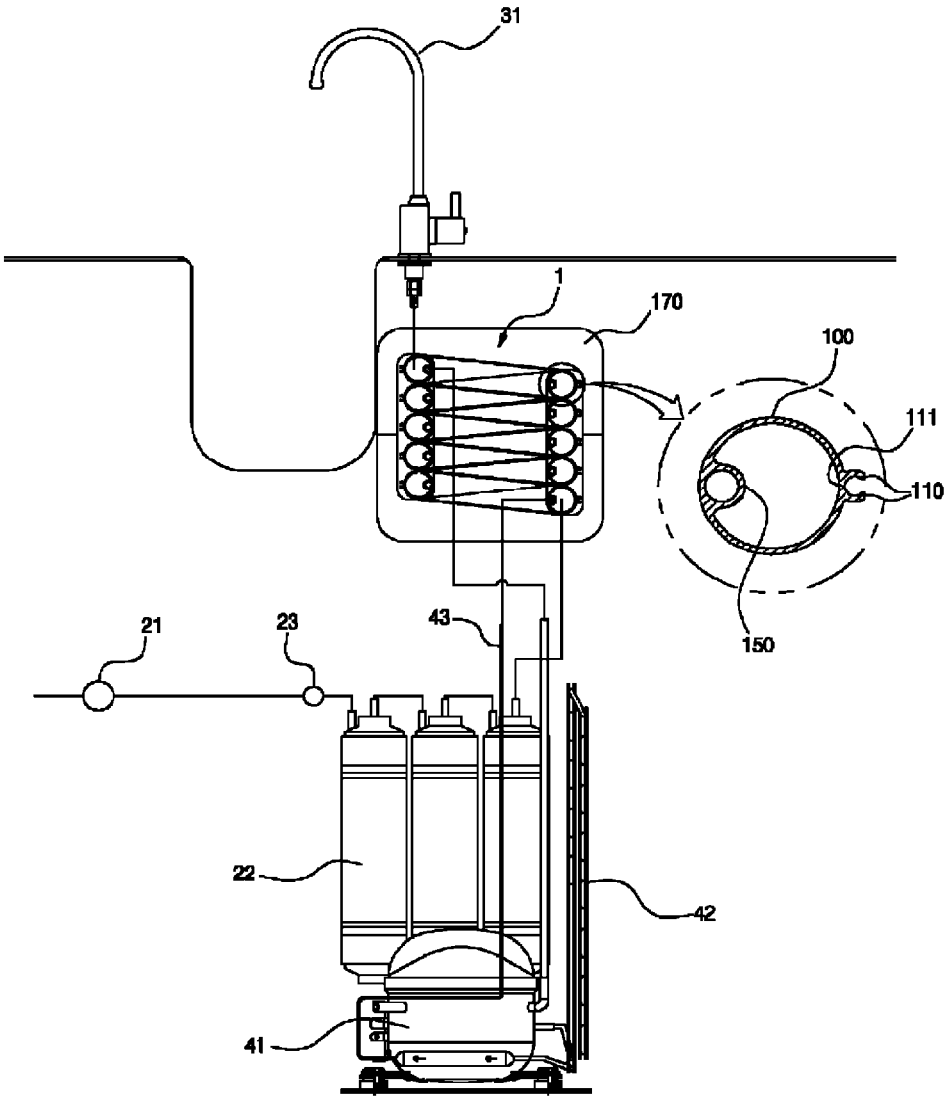
FIG. 3 is a view showing a state where a temperature control pipe is disposed on an inner wall surface of a feed pipe.
Figure 4:
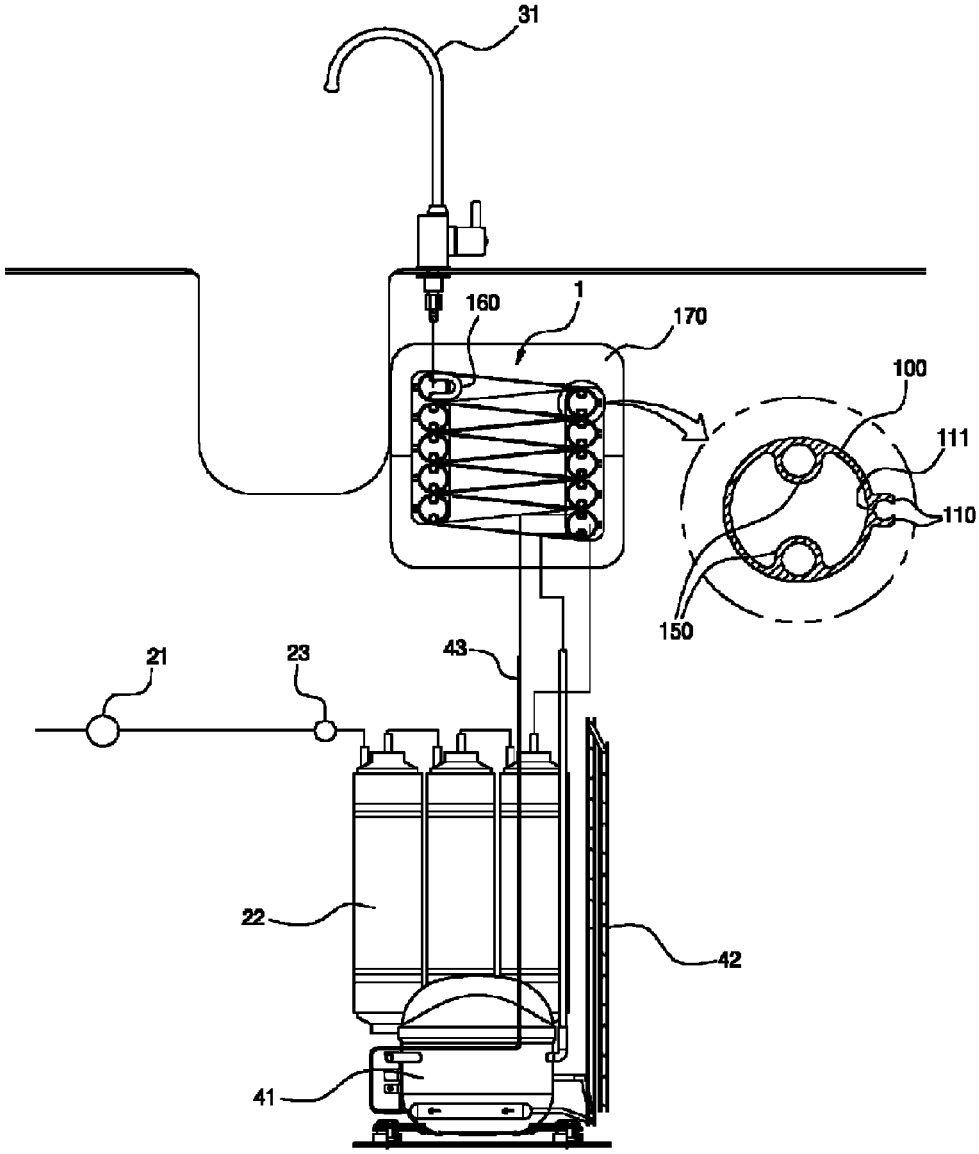
FIG. 4 is a view showing a state where a plurality of temperature control pipes are disposed on an inner wall surface of a feed pipe.

FIG. 3 is a view showing a state where the temperature control pipe is disposed on an inner wall surface of the feed pipe, and FIG. 4 is a view showing a state where a plurality of the temperature control pipes are disposed on an inner wall surface of the feed pipe.

Referring to FIG. 3, the hot and cold water pipe 1 according to the present invention has the same structure as the cold water tank illustrated in FIGS. 1 and 2, excepting that the temperature control pipe 150 is in contact with the inner circumferential surface of the feed pipe 100. In this instance, the temperature control pipe 150 is extrusion-molded integrally with the feed pipe 100 in the state where it is in contact with the inner circumferential surface of the feed pipe 100. It does not matter that the temperature control pipe 150 is disposed on which part of the inner circumferential surface of the feed pipe 100. As shown in the drawings, disposing the temperature control pipe 150 on the inner circumferential surface of the feed pipe 100 of a spiral structure is useful in reducing heat loss.

Referring to FIG. 4, the cold water tank according to the present invention includes a plurality of temperature control pipes 150 that are in contact with the inner circumferential surface of the feed pipe 100, and preferably, two temperature control pipes 150 that are disposed at opposed portions of the inner circumference of the feed pipe 100 in a reciprocating manner.

In more detail, the temperature control pipes 150 are disposed at the opposed portions of the inner circumference of the feed pipe 100 along the longitudinal direction of the feed pipe 100, and the feed pipe 100 has pipe connection parts 160 disposed at end portions of the feed pipe 100 for connecting ends of the temperature control pipes 150 with each other, so that the temperature control pipes 150 may reciprocate in the longitudinal direction of the feed pipe 100. In this instance, the pipe connection parts 160 may be formed integrally with the temperature control pipe 150 in a state where they are contained in the temperature control pipe 150 or may be formed by additional members, such as connection pipes, which are sealably joined to each of the ends of the temperature control pipe 150.

The temperature control pipe 150 includes cooling means or heating means disposed therein. The temperature control pipe 150 having the cooling means or the heating means may be arranged in a reciprocating cycle between an end and the other end of the feed pipe 100 to thereby enhance heat exchange efficiency to the feed pipe 100.

The hot and cold water dispenser illustrated in FIGS. 3 and 4 has the same structure as the hot and cold water dispenser illustrated in FIG. 2, excepting the internal structure of the feed pipe.

Figure 5:
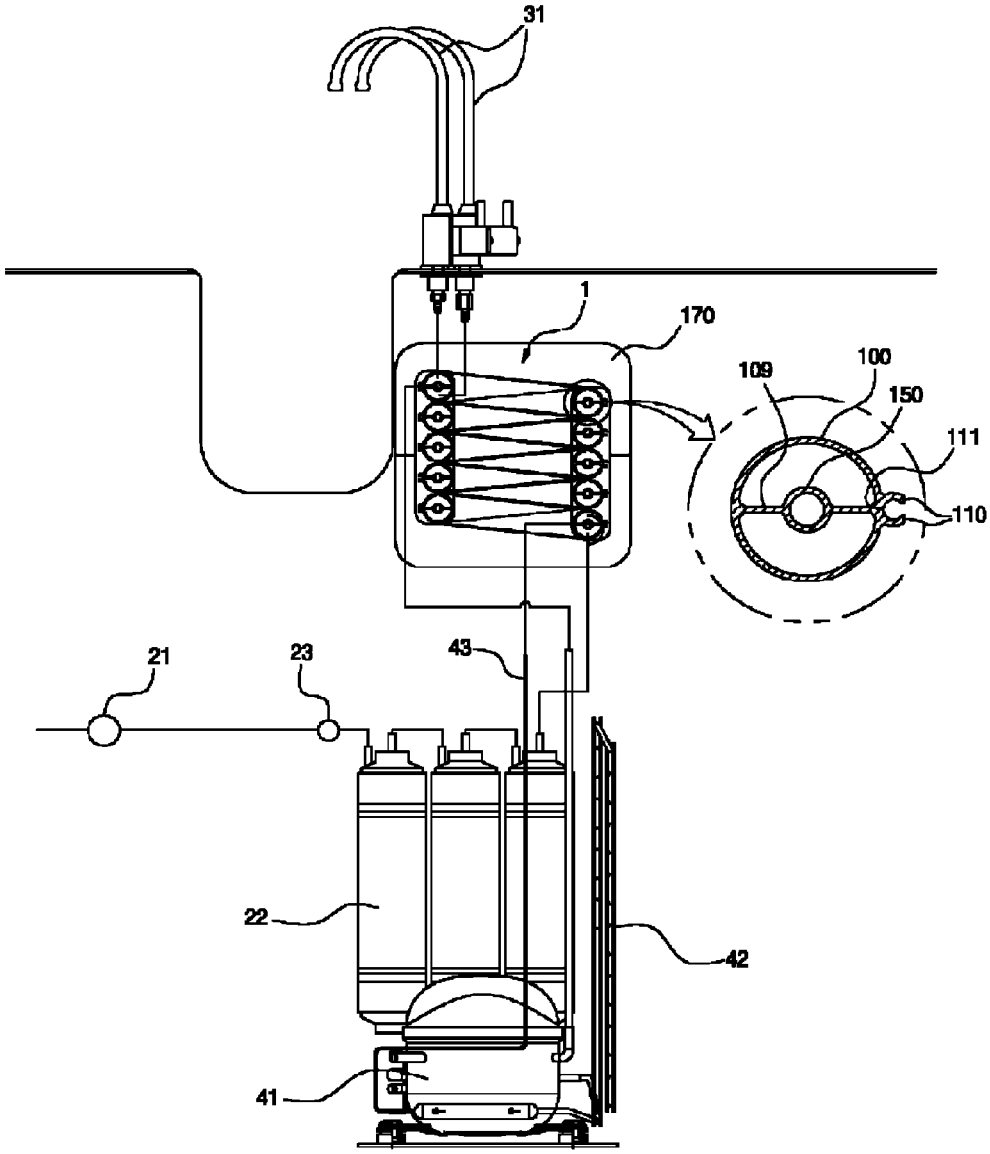
FIG. 5 is a view showing a state where a partition is formed inside the feed pipe of the hot and cold water dispenser according to the present invention.

FIG. 5 is a view showing a state where a partition is formed inside the feed pipe of the hot and cold water dispenser according to the present invention.

Referring to FIG. 5, the hot and cold water dispenser according to the present invention includes a partition 109 formed inside the feed pipe 100, and the temperature control pipe 150 is formed at the center of the partition 109 in integration with the partition 109. As shown in the drawing, the partition 109 may traverse the inside of the feed pipe 100 and divide the inside of the feed pipe 100 into two parts. However, the above structure is to show a preferred embodiment of the present invention and is not restricted to the above, and the feed pipe 100 may have at least two partitions therein.

Because the flow path is divided by the partition 109, water flowing inside the divided flow paths may be discharged through separate water outlets 31. Therefore, the hot and cold water dispenser according to this embodiment has two water outlets 31.

In this embodiment, the partition 109, the feed pipe 100, and the temperature control pipe 150 may be molded integrally with one another, and the partition 109 traverses the temperature control pipe 150 and divides the inner flow path of the feed pipe 100 into halves.

The hot and cold water dispenser illustrated in FIG. 3 5 has the same structure as the hot and cold water dispenser illustrated in FIG. 2, excepting the internal structure of the feed pipe.

Figure 6:
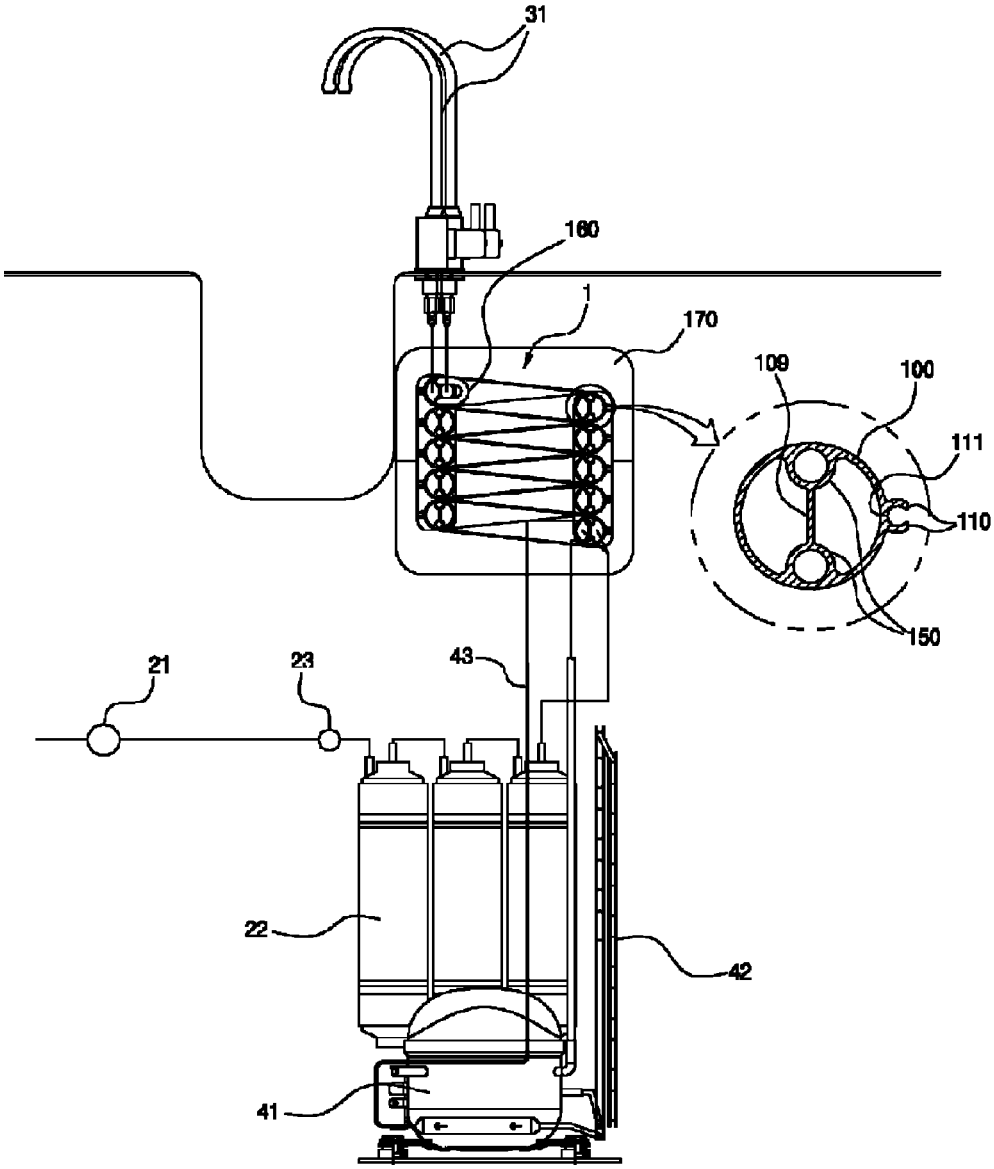
FIG. 6 is a view showing a state where a partition is formed inside the feed pipe according to another preferred embodiment of the present invention.

FIG. 6 is a view showing a state where a partition is formed inside the feed pipe according to another preferred embodiment of the present invention.

Referring to FIG. 6, the feed pipe 100 of the hot and cold water pipe 1 according to the present invention includes a partition 109 formed therein, and temperature control pipes 150 are disposed at both ends of the partition 109. That is, the partition 109 is disposed in the form that it connects the temperature control pipes 150 oppositely formed on the inner circumferential surface of the feed pipe 100, and divides the inner flow path of the feed pipe 100 into halves. Furthermore, like the embodiment of the hot and cold water dispenser illustrated in FIG. 5, the hot and cold water dispenser of this embodiment has two water outlets. Other structures of the feed pipe 100 and the refrigeration system are the same as the hot and cold water dispenser illustrated in FIG. 2.

Meanwhile, the temperature control pipe 150 has a space for accommodating the cooling means or the heating means therein to carry out the above functions. In the case that the cooling means is accommodated in the space, the feed pipe 100 serves as a cold water pipe, but in the case that the heating means is accommodated in the space, the feed pipe 100 serves as a hot water pipe.

FIGS. 2 to 6 are conceptual diagrams of a cold water supply system that the feed pipe 100 functions as the cold water pipe, wherein the cooling means accommodated in the temperature control pipe 150 may be refrigerant and a refrigeration cycle where the refrigerant circulates is formed. In detail, the cold water supply system, like a general cooling device, includes a compressor 41, a condenser 42, an expansion valve (capillary tube) 43, and an evaporator, in which refrigerant circulates.

In this instance, the temperature control pipe 150 of this embodiment serves as the evaporator. The refrigerant passing through the temperature control pipe 150 causes heat exchange between the temperature control pipe 150 and the feed pipe 100 while absorbing latent heat of vaporization, and as a result, water inside the feed pipe 100 is cooled.

As shown in FIGS. 4 and 6, in the case that the temperature control pipe 150 is in the reciprocating cycle between one end and the other end of the feed pipe 100, the refrigerant reciprocatingly circles in the longitudinal direction of the feed pipe 100 to thereby enhance the cooling efficiency.

In such a cold water supply system, an end portion of the temperature control pipe 150 is connected with an end of the capillary tube 43 and the other end portion is connected with the compressor 41.

Differently from the above, in the case that the feed pipe 100 serves as the hot water pipe, heating means is accommodated in the temperature control pipe 150. As an example of the heating means, there is a heater rod or a heater pipe (not shown), which is heated by receiving electric power from the outside. Alternatively, the temperature control pipe 150 may be connected with a separate steam pipe, so that steam of high temperature can move inside the temperature control pipe 150.

In the meantime, the feed pipe 100 may further include a pair of seating ribs 110 protruding from the outer circumferential surface of the feed pipe 100 and formed along the longitudinal direction of the feed pipe 100. A seating groove 111 is formed between the seating ribs 110, and a temperature sensor (not shown) may be joined to the seating groove 111. Furthermore, the temperature sensor senses the inside temperature of the feed pipe 100.

Additionally, the hot and cold water dispenser may further include a heat insulator 170. As shown in FIGS. 1 to 5, the heat insulator 170 surrounds the feed pipe 100. The heat insulator 170 can enhance thermal efficiency of the hot and cold water dispenser by preventing heat exchange between the feed pipe 100 and the outside air.

The hot and cold water dispenser according to the present invention may further include connectors (not shown) for connecting an end portion of the feed pipe 100 to the water supply pipe 21 and connecting the other end portion of the feed pipe 100 to the water outlet 31. In the state where the connectors are joined to both end portions of the feed pipe 100, the connector connected to one end portion of the feed pipe 100 is connected with the water supply pipe 21 and the other connector connected to the other end portion of the feed pipe 100 is connected with the water outlet 31. In this instance, the connectors may be directly connected to the water supply pipe 21 or the water outlet 31 or may be indirectly connected through a connection pipe or a connection hose (not shown) connected to the water supply pipe 21 or the water outlet 31. Water of the water supply pipe 21 can be introduced into the inner flow path of the feed pipe 100 through the connector connected to one end portion of the feed pipe 100, and the water filling the inner flow path of the feed pipe 100 can be discharged to the water outlet 31 through the connector connected to the other end portion of the feed pipe 100. The connectors will be described in detail later.

Figure 7:
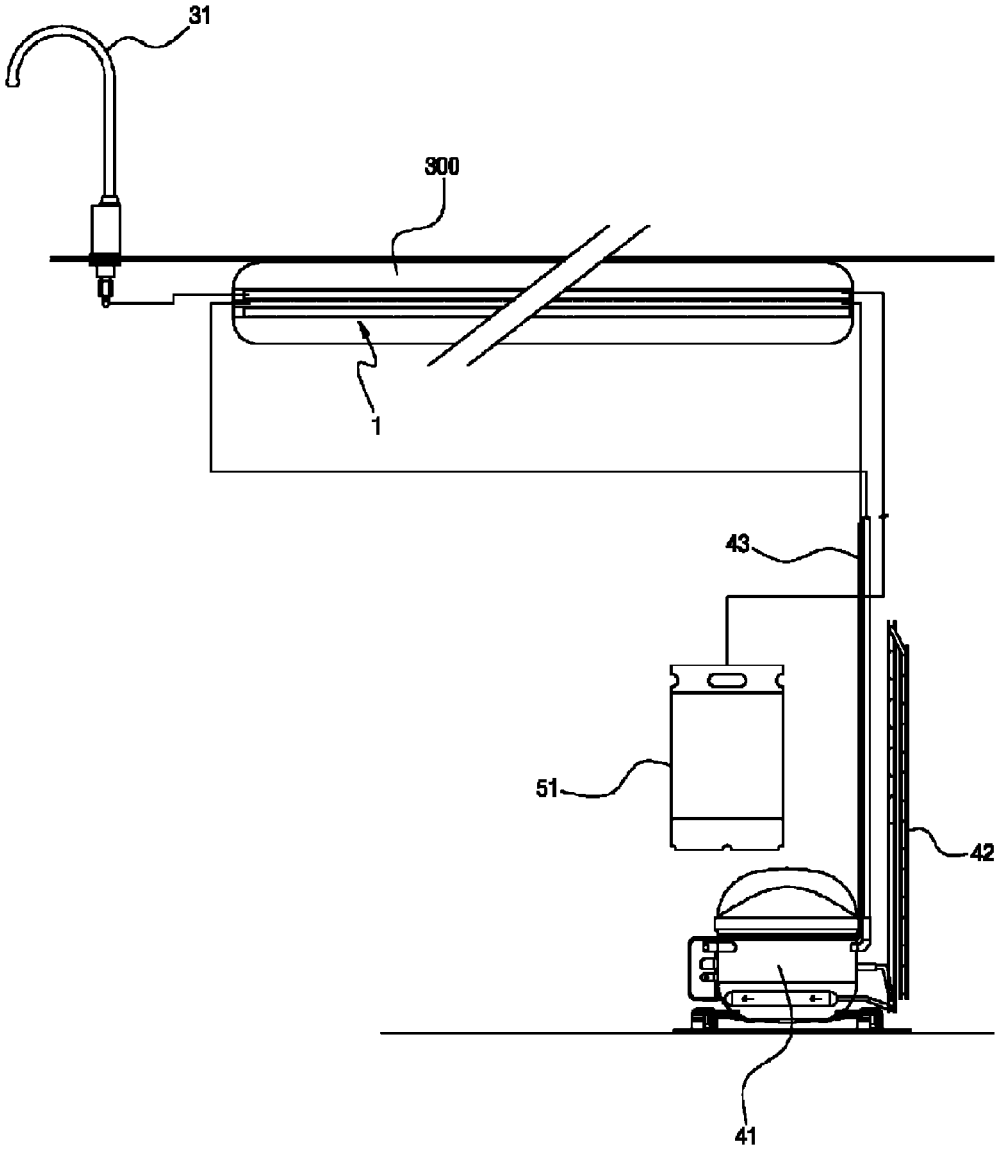
FIG. 7 is a conceptual diagram of a beer supply system having the feed pipe of the hot and cold water dispenser according to the present invention.

FIG. 7 is a conceptual diagram of a beer supply system having the feed pipe of the hot and cold water dispenser according to the present invention.

The feed pipe 100 and the temperature control pipe 150 constituting the hot and cold water pipe 1 of the beer supply system are the same as the feed pipe 100 and the temperature control pipe 150 illustrated in FIGS. 1 to 6. The feed pipe 100 and the temperature control pipe 150 illustrated in FIGS. 1 and 2 are applied to FIG. 7. However, FIG. 7 illustrates an example that the feed pipe 100 is not in a coiled form but in a linear form.

In this embodiment, an end portion of the feed pipe 100 is connected with a beer storage tank 51, and hence, beer is introduced into the feed pipe 100. Furthermore, the temperature control pipe 150 is connected with the cooling device and serves as an evaporator. Accordingly, beer introduced into the feed pipe 100 can be cooled or keep a cooled state, and then, can be discharged out through the water outlet 31 as the need arises.

Such a system can be used in bars. In detail, a water outlet 31 is put on a table, and the hot and cold water pipe 1 connected to the water outlet 31 is put under the table and connected to the beer storage tank 51, whereby drinkers or a manager can directly receive cool beer at the table as the need arises. In this instance, the beer supply system may further include additional means, for instance, a shut off valve (not shown), which can control the quantity of beer discharged from the water outlet 31.

Figure 8:
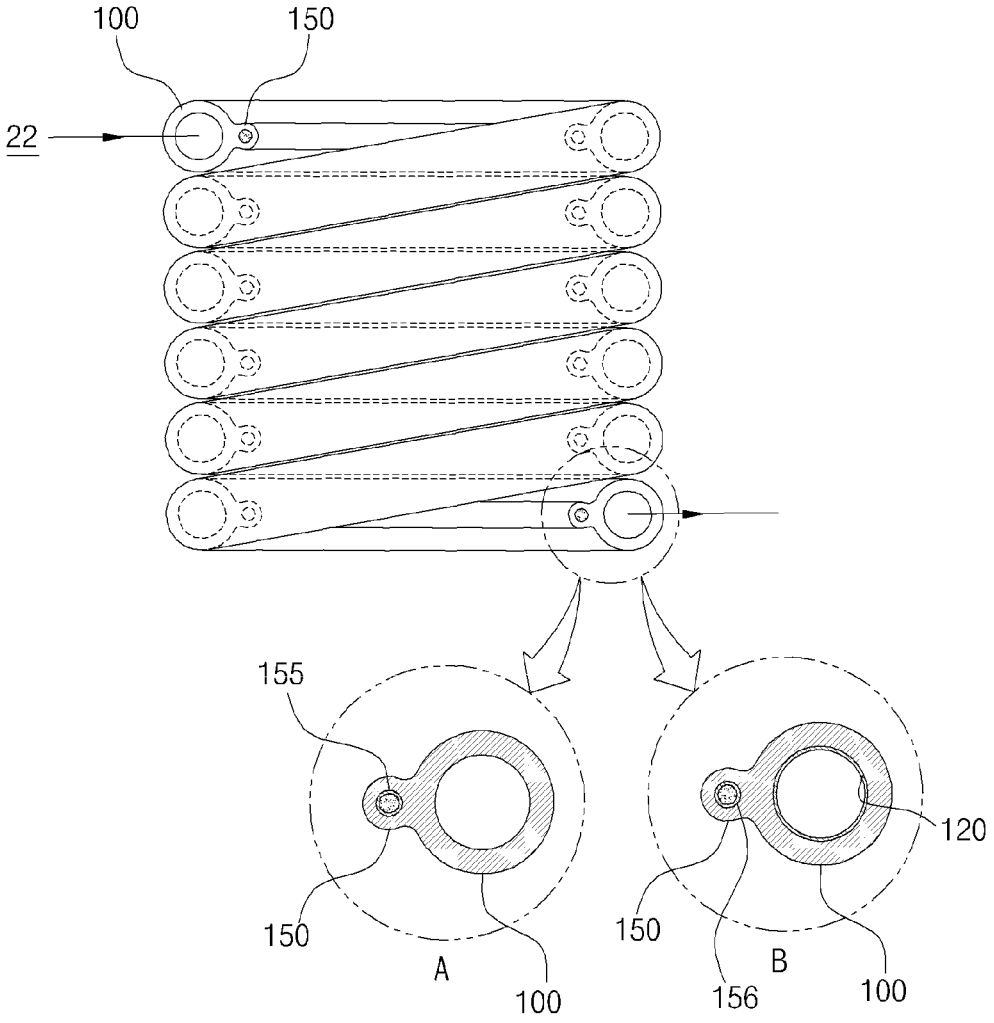
FIG. 8 is a view showing a state where the temperature control pipe is disposed outside the feed pipe.
Figure 9:
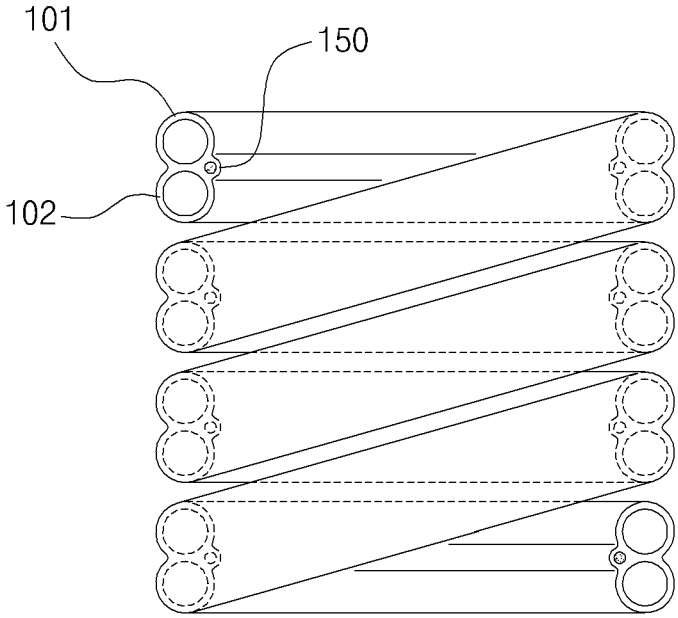
FIG. 9 is a view showing a state where two feed pipes are disposed around the temperature control pipe.
Figure 10:
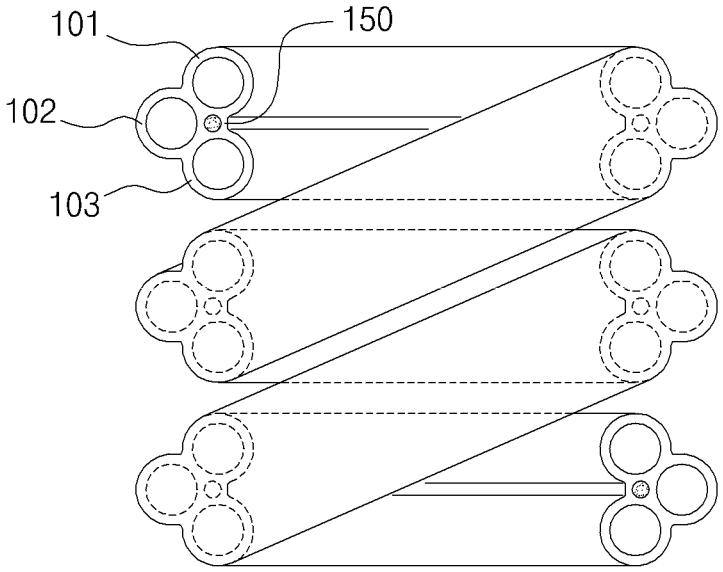
FIG. 10 is a view showing a state where three feed pipes are disposed around the temperature control pipe.
Figure 11:
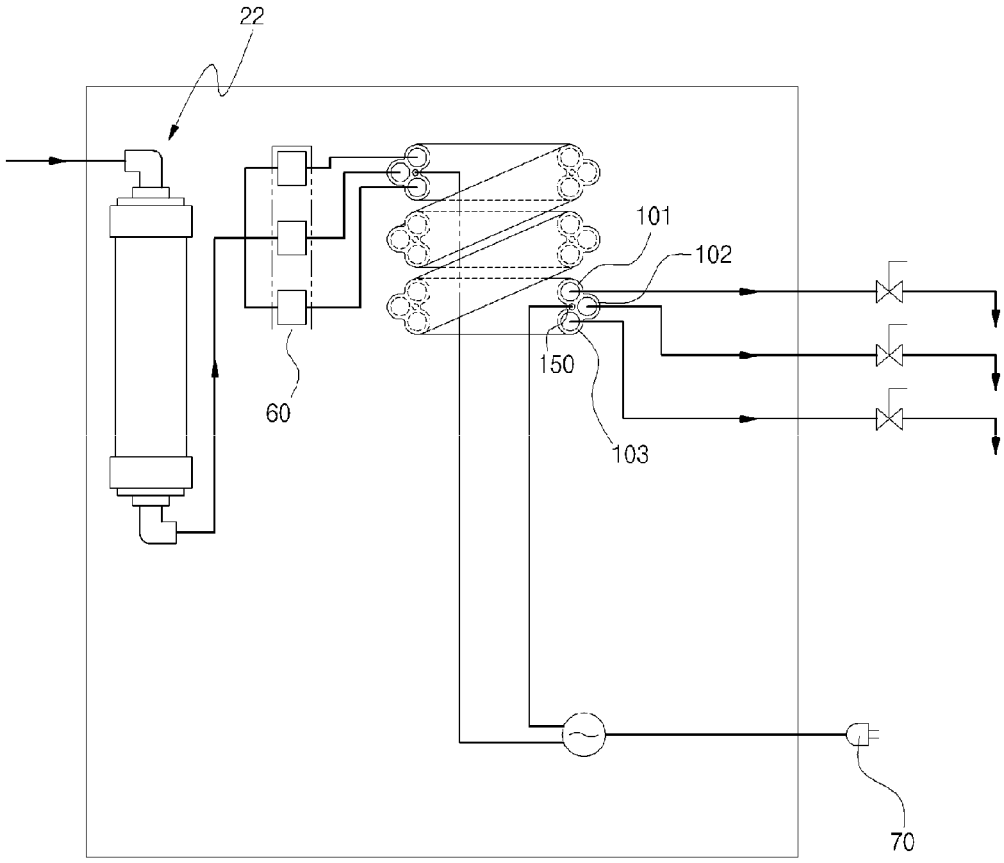
FIG. 11 is a schematic diagram of the hot and cold water dispenser having a hot and cold water pipe shown in FIGS. 8 to 10.

FIG. 8 is a view showing a state where the temperature control pipe is disposed outside the feed pipe, FIG. 9 is a view showing a state where two feed pipes are disposed around the temperature control pipe, FIG. 10 is a view showing a state where three feed pipes are disposed around the temperature control pipe, and FIG. 11 is a schematic diagram of the hot and cold water dispenser having a hot and cold water pipe shown in FIGS. 8 to 10.

First, referring to FIGS. 8 and 10, the feed pipe 100 of the hot and cold water dispenser according to the present invention includes a temperature control pipe 150, which is disposed on the outer circumference of the feed pipe. The feed pipe 100 has a one-way flow path and serves as a path for allowing a flow of water from a water supply, such as the water supply pipe or a drinking water bottle. The temperature control pipe 150 is in contact with the feed pipe 100 along a longitudinal direction of the feed pipe 100 and heats or cools the feed pipe 100 by energy supplied from the outside. In this instance, the feed pipe 100 and the temperature control pipe 150 are formed integrally with each other and directly perform a mutual heat transfer.

The feed pipe 100 and the temperature control pipe 150 are extrusion-molded integrally, and as shown in the drawings, are in a coiled form by being turned at least once, wherein the temperature control pipe 150 is arranged inside the coiled form and the feed pipe 100 is arranged outside the coiled form. As described above, the temperature control pipe 150 is arranged inside the coiled form in order to continuously heat or cool water of the feed pipe 100 without discharging the heat or the cold to the outside. However, the form of the feed pipe 100 is not restricted to the coiled from and can be changed in various ways, for instance, in a linear form or in a meandering form, according to installation environments and sizes of installation spaces.

In this instance, the inner circumferential surfaces and the outer circumferential surfaces of the feed pipe 100 and the temperature control pipe 150 may be treated by anodizing or coated with anti-corrosive paints or with anti-corrosive resin, and tubes may be respectively or selectively inserted into the feed pipe 100 and the temperature control pipe 150 in order to enhance thermal conductivity or corrosion resistance or to keep good hygienic conditions.

In other words, an inner tube 155 that is made of copper, an alloy of copper or stainless steel with good thermal conductivity is inserted into the temperature control pipe 150, and the outer circumferential surface of the inner tube 155 is in contact with the inner circumferential surface of the temperature control pipe 150 and fixed to the temperature control pipe 150. In another preferred embodiment, a first inner tube 156 that is made of copper or an alloy of copper is inserted into the temperature control pipe 150 and the outer circumferential surface of the first inner tube 156 is in contact with the inner circumferential surface of the temperature control pipe 150 and fixed to the temperature control pipe 150, and a second inner tube 120 that is made of stainless steel or ceramic is inserted into the feed pipe 100 and the outer circumferential surface of the second inner tube 120 is in contact with the inner circumferential surface of the feed pipe 100 and fixed to the feed pipe 100.

Meanwhile, in the hot and cold water dispenser according to the present invention, a single feed pipe 100 may be formed integrally as shown in FIG. 8, or a plurality of feed pipes 100 may be formed integrally as shown in FIGS. 9 and 10.

That is, as shown in FIG. 9, a pair of the feed pipes 101 and 102 or three feed pipes 101, 102 and 103 as shown in FIG. 10 make a group and are arranged in such a way that the temperature control pipe 150 is in contact with all of the two feed pipes 101 and 102 or in contact with all of the three feed pipes 101, 102 and 103.

For reference, hereinafter, the structure that the three feed pipes 101, 102 and 103 and the temperature control pipe 150 are combined together, as shown in FIG. 10, will be described and the three feed pipes 101, 102 and 103 are called the plural feed pipes 101, 102 and 103.

The plural feed pipes 101, 102 and 103 respectively have one-way flow paths parallel with each other, and the temperature control pipe 150 is formed along the longitudinal direction of the plural feed pipes 101, 102 and 103 in such a way as to be in contact with all of the plural feed pipes 101, 102 and 103, so that the temperature control pipe 150 absorbs heat of the plural feed pipes 101, 102 and 103 or heats the plural feed pipes 101, 102 and 103. In this instance, it is preferable that the temperature control pipe 150 is smaller in diameter than the plural feed pipes 101, 102 and 103, so that the temperature control pipe 150 can be in contact with all of the plural feed pipes 101, 102 and 103 without taking up much space.

In the meantime, the plural feed pipes 101, 102 and 103 are respectively connected with a water purification filter 22, and converters 60 for converting the property of water filtered through the water purification filter 22 may be mounted among the water purification filter 22 and the plural feed pipes 101, 102 and 103. The converters 60 may be formed by combination of at least one of a sulfur hot spring water dispenser, which generates sulfur hot spring water using sulfur to allow the user to enjoy hot springs, a germanium hot spring water dispenser, which generates germanium hot spring water using germanium, a water softener, which generates soft water good for skin, an alkaline hot spring water dispenser, which generates alkaline hot spring water, and an anion water dispenser, which generates anionic water, in order to generate various properties of water according to the user's purposes and demands.

Therefore, the converter 60 may include various kinds of devices for generating water containing various ingredients and properties, which are respectively mounted between the water purification filter 22 and the plural feed pipes 101, 102 and 103.

Till now, the embodiment that the temperature control pipe 150 is disposed outside the feed pipe 100 is described, and other components of the hot and cold water dispenser according to the present invention are the same as or similar to those of the hot and cold water dispenser illustrated in FIGS. 1 to 7, and hence, descriptions thereof will be omitted. Moreover, FIG. 11 schematically illustrates a heating structure that a heater rod is disposed inside the temperature control pipe 150 and generates heat by an external power supply 70 to heat the feed pipe, but instead of the heating structure, a cooling structure that refrigerant flows inside the temperature control pipe 150 to cool water in the feed pipe 100 may be adopted.

Figure 12:
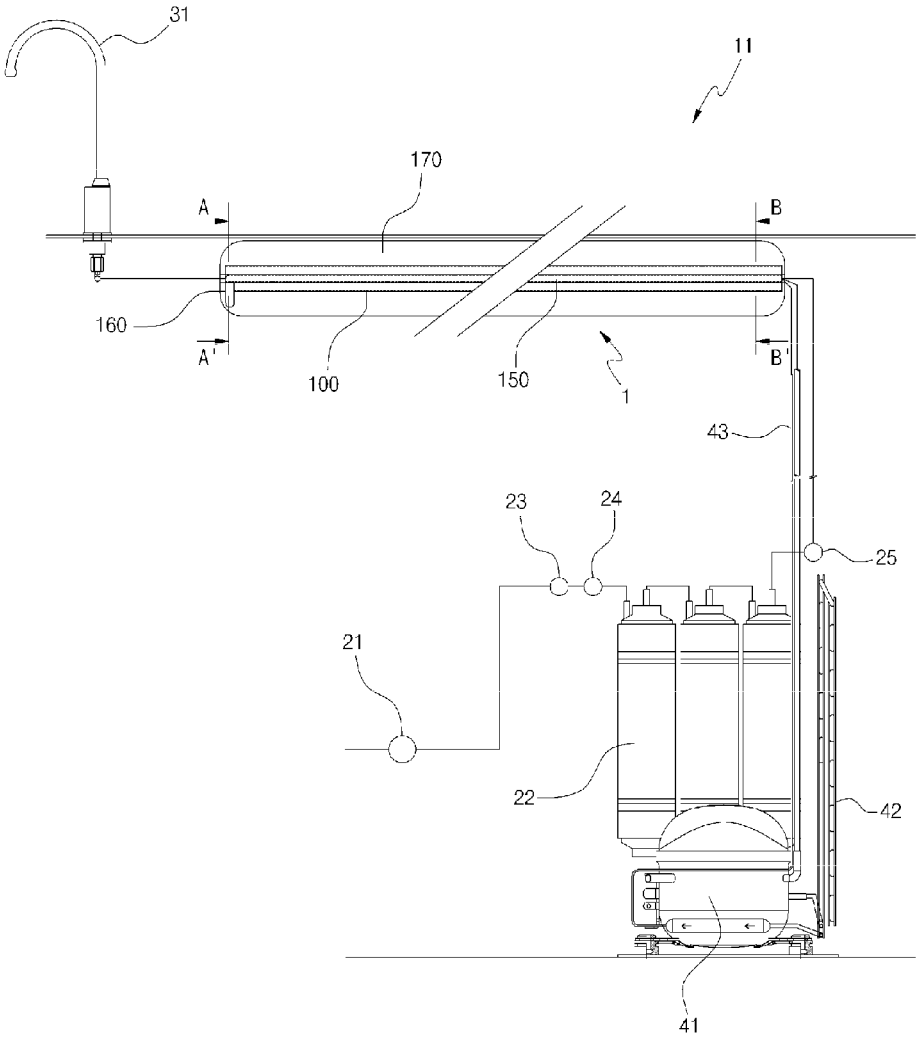
FIG. 12 is a schematic diagram of a cold water supply system having a hot and cold water pipe according to another preferred embodiment of the present invention.
Figure 13:
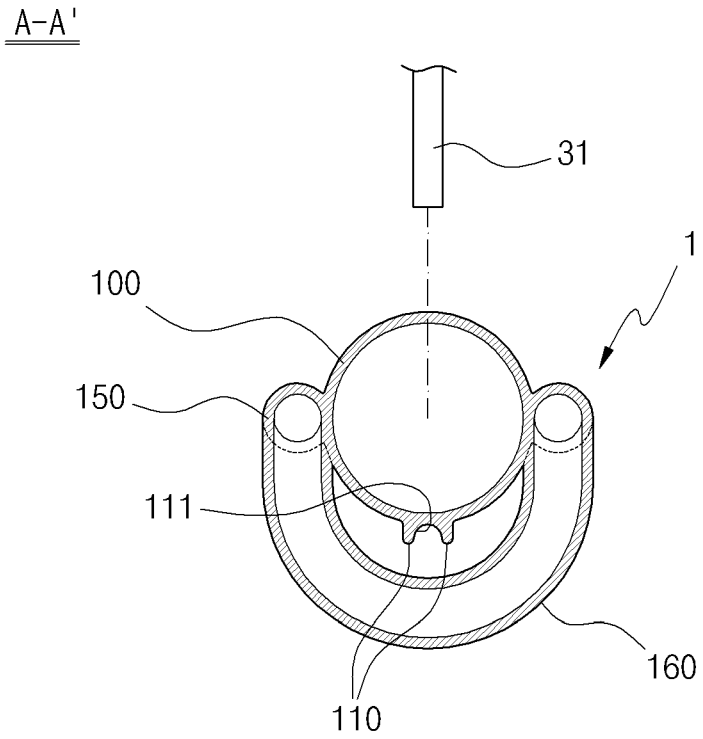
FIGS. 13 and 14 are enlarged perspective views of both end portions of the hot and cold water pipe shown in FIG. 12.
Figure 14:
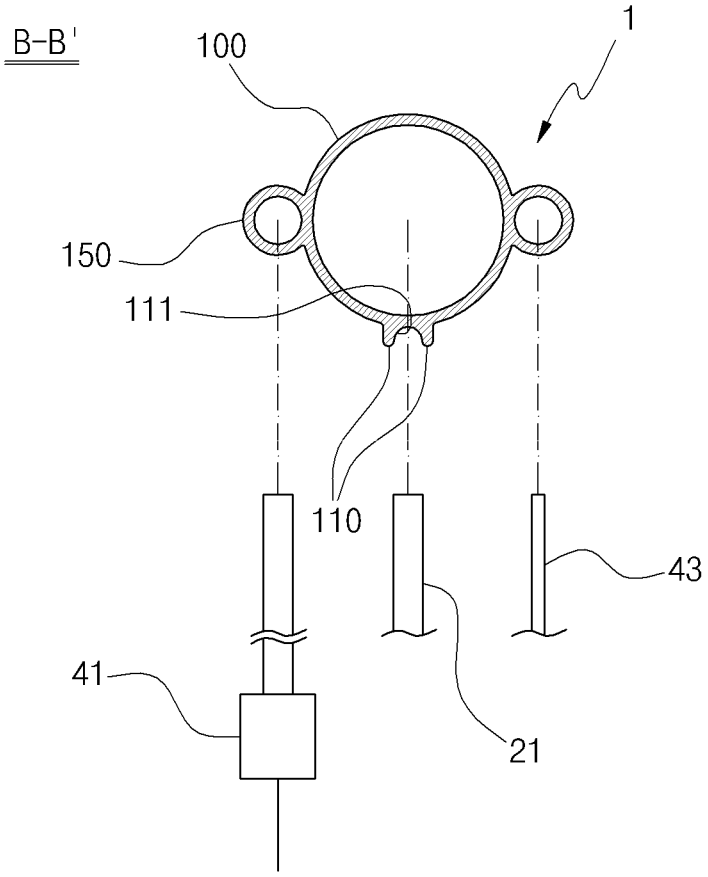

FIG. 12 is a schematic diagram of a cold water supply system having a hot and cold water pipe according to another preferred embodiment of the present invention, and FIGS. 13 and 14 are enlarged perspective views of both end portions of the hot and cold water pipe shown in FIG. 12.

Referring to FIGS. 12 to 14, the hot and cold water pipe 1 of the hot and cold water dispenser according to another preferred embodiment of the present invention includes a feed pipe 100 and a temperature control pipe 150, and the temperature control pipe 150 is reciprocatingly formed along a longitudinal direction of the feed pipe 100 in order to enhance heat exchange efficiency. It is preferable that the temperature control pipe 150 that is formed along the longitudinal direction of the feed pipe 100 has a length corresponding to the length of the feed pipe 100 ranging from one end to the other end of the feed pipe 100 to generally carry out heat exchange along the longitudinal direction of the feed pipe 100. Furthermore, the temperature control pipe 150 is formed integrally with the feed pipe 100 to carry out a smooth heat exchange with the feed pipe 100.

In more detail, as shown in FIGS. 12 to 14, the temperature control pipes 150 are formed on both sides of the outer face of the feed pipe 100 along the longitudinal direction of the feed pipe 100, and the feed pipe 100 has pipe connection parts 160 disposed at end portions of the feed pipe 100 for connecting ends of the temperature control pipes 150 with each other, so that the temperature control pipes 150 may reciprocate in the longitudinal direction of the feed pipe 100. In this instance, the pipe connection parts 160 may be formed integrally with the temperature control pipe 150 in a state where they are contained in the temperature control pipe 150 or may be formed by additional members, such as connection pipes, which are sealably joined to each of the ends of the temperature control pipe 150.

The temperature control pipe 150 includes cooling means or heating means disposed therein. The temperature control pipe 150 having the cooling means or the heating means may be arranged in a reciprocating cycle between an end and the other end of the feed pipe 100 to thereby enhance heat exchange efficiency to the feed pipe 100. In this instance, FIGS. 12 to 14 illustrate a state where the temperature control pipe 150 is disposed on the outer circumferential surface of the feed pipe 100 as an example, but the temperature control pipe 150 may be disposed inside the feed pipe. (Refer to FIG. 4)

The temperature control pipe 105 serves as the cooling means or the heating means as described above. FIG. 12 is a conceptual diagram of the system that the temperature control pipe 150 serves as cooling means.

FIG. 12 illustrates an example of a cold water supply system, in which the cooling means accommodated in the temperature control pipe 150 is refrigerant, and, which has a refrigeration cycle for circulating the refrigerant. In detail, the cold water supply system 11, like the general cooling device, includes a compressor 41, a condenser 42, an expansion valve (capillary tube) 43, and an evaporator, in which refrigerant circulates. The cooling device and the cooling method using the cooling device are known technologies, and hence, detailed descriptions thereof will be omitted.

In the meantime, differently from the above, in the case that the hot and cold water pipe 1 serves as a hot water pipe, heating means is accommodated in the temperature control pipe 150. As an example of the heating means, there is a heater rod or a heater pipe (not shown), which is heated by receiving electric power from the outside. Alternatively, the temperature control pipe 150 may be connected with a steam pipe, so that steam of high temperature can move inside the temperature control pipe 150.

Moreover, the hot and cold water pipe 1 may further include a heat insulator 170 surrounding the feed pipe 100 and the temperature control pipe 150 together. As shown in FIG. 12, the heat insulator 170 is formed along the longitudinal direction of the feed pipe 100 while surrounding the feed pipe 100 and the temperature control pipe 150 together. The heat insulator 170 can prevent heat exchange between the feed pipe 100 and the outside air and between the temperature control pipe 150 and the outside air to thereby enhance thermal efficiency of the cold or hot water supply system having the hot and cold water pipe 1 of this embodiment of the present invention.

Figure 15:
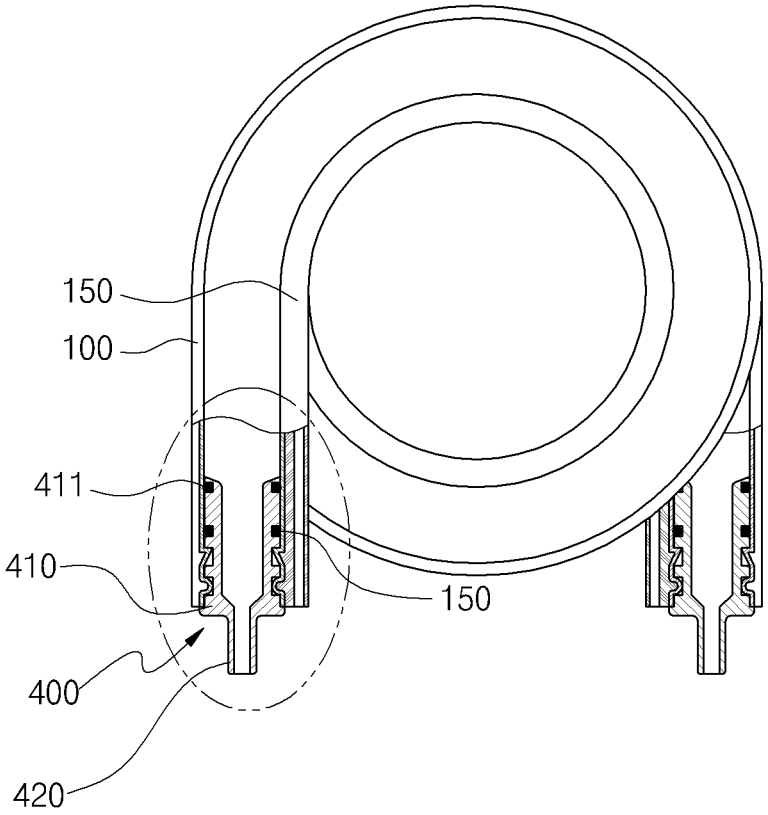
FIG. 15 is a view showing a state where connectors are disposed at end portions of the feed pipe.
Figure 16:
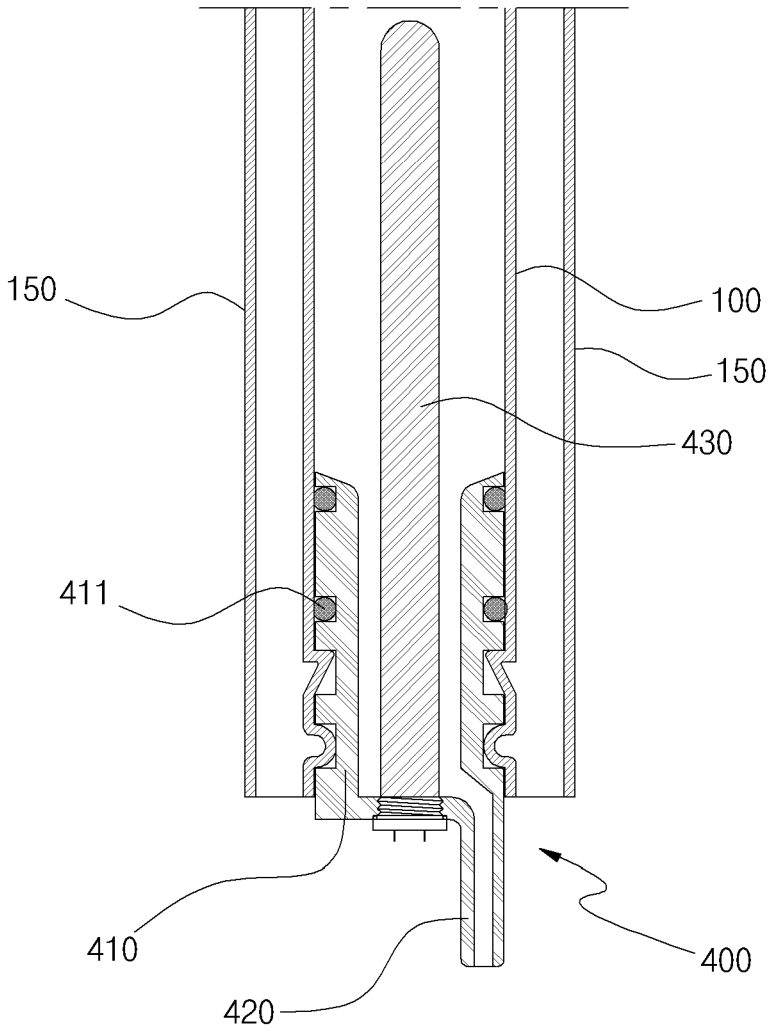
FIG. 16 is a view showing another example of the connectors disposed at the end portions of the feed pipe.

FIG. 15 is a view showing a state where connectors are disposed at end portions of the feed pipe, and FIG. 16 is a view showing another example of the connectors disposed at the end portions of the feed pipe.

Referring to FIGS. 15 and 16, connectors 400, which can be connected with the water supply pipe 21 or the water outlet 31, are disposed at end portions of the feed pipe 100 of the hot and cold water dispenser according to the present invention.

The connectors 400 are joined to the end portions of the feed pipe 100 and can be directly connected with the water supply pipe 21 or the water outlet 31 or indirectly connected with the water supply pipe 21 or the water outlet 31 through connection pipes (not shown).

The connectors 400 may be inserted and joined into the end portions of the feed pipe 100 or the end portions of the feed pipe 100 may be inserted and joined into the connectors 400 (not shown in the drawings).

Each of the connectors 400 includes a body 410 inserted and joined into the end portion of the feed pipe 100, and a connecting member 420 extending from the body 410 and connected with the water supply pipe 21 or the water outlet 31. The body 410 and the connecting member 420 communicate with each other, and an end portion of the body 410, which is inserted into the end portion of the feed pipe 100, and an end portion of the connecting member 420 are opened. Therefore, when the connector 400 is inserted and joined into the feed pipe 100, the inside of the feed pipe 100 and the inside of the connector 400 communicate with each other, and water contained in the feed pipe 100 can be introduced into the feed pipe 100 through the connecting member 420 of the connector 400.

Additionally, at least one O-ring 411 may be interposed between the outer circumference of the body 410 and the inner circumference of the feed pipe 100, which are in contact with each other, in order to keep watertightness inside the feed pipe 100. Moreover, the connector 400 may further include a germicidal lamp 430 disposed inside the connector 400 for irradiating UV rays to the inside of the feed pipe 100 (see FIG. 16). The germicidal lamp 430 passes through the body 410 and is joined to the inside of the body 410 in a state where the connecting member 420 extends from a biased position of the body 410. The germicidal lamp 430 serves to remove biologically hazardous substances, such as germs, in water flowing inside the feed pipe 100 while irradiating UV rays.

Moreover, nano silver coating or photocatalyst coating may be carried out to at least one of the inner and outer circumferential surfaces of the connector 400 in order to sterilize water inside the feed pipe 100.

Figure 17:
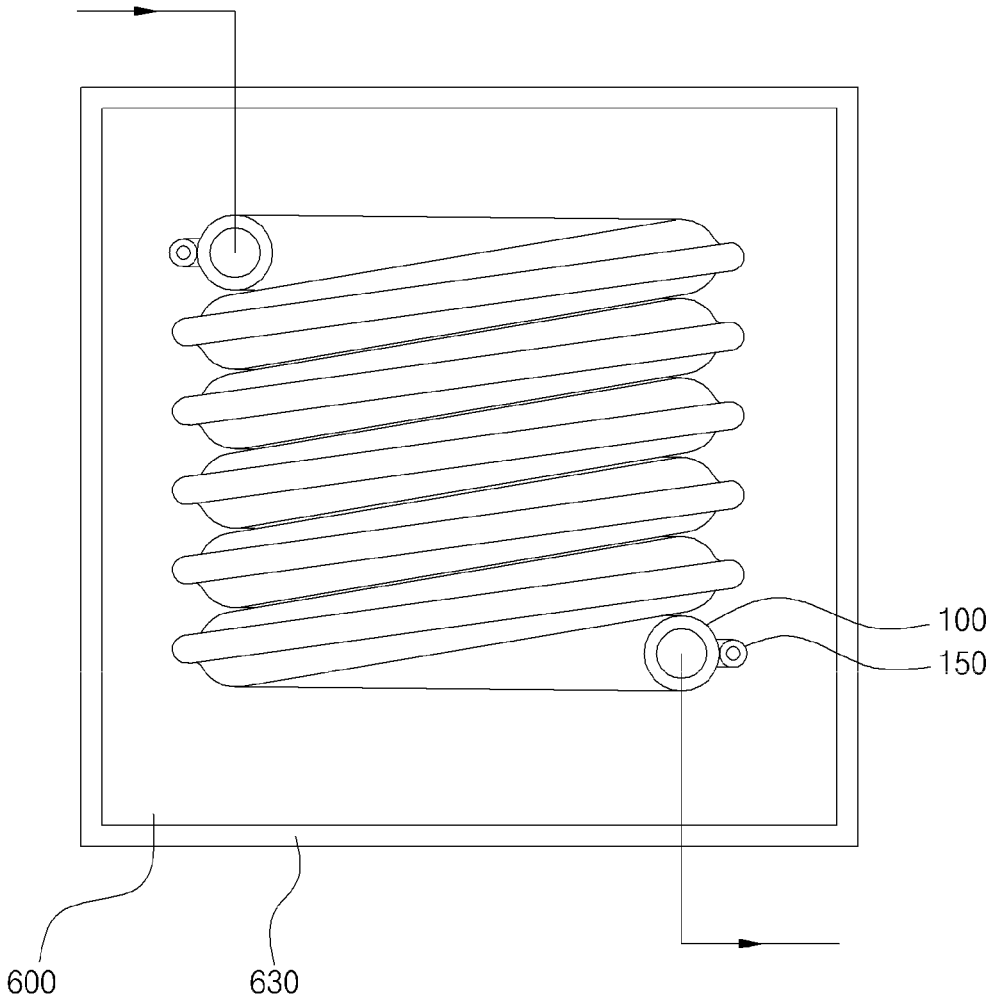
FIG. 17 is a view showing a protection part is disposed on the outer circumferences of the feed pipe and the temperature control pipe of the hot and cold water dispenser according to the present invention.
Figure 18:
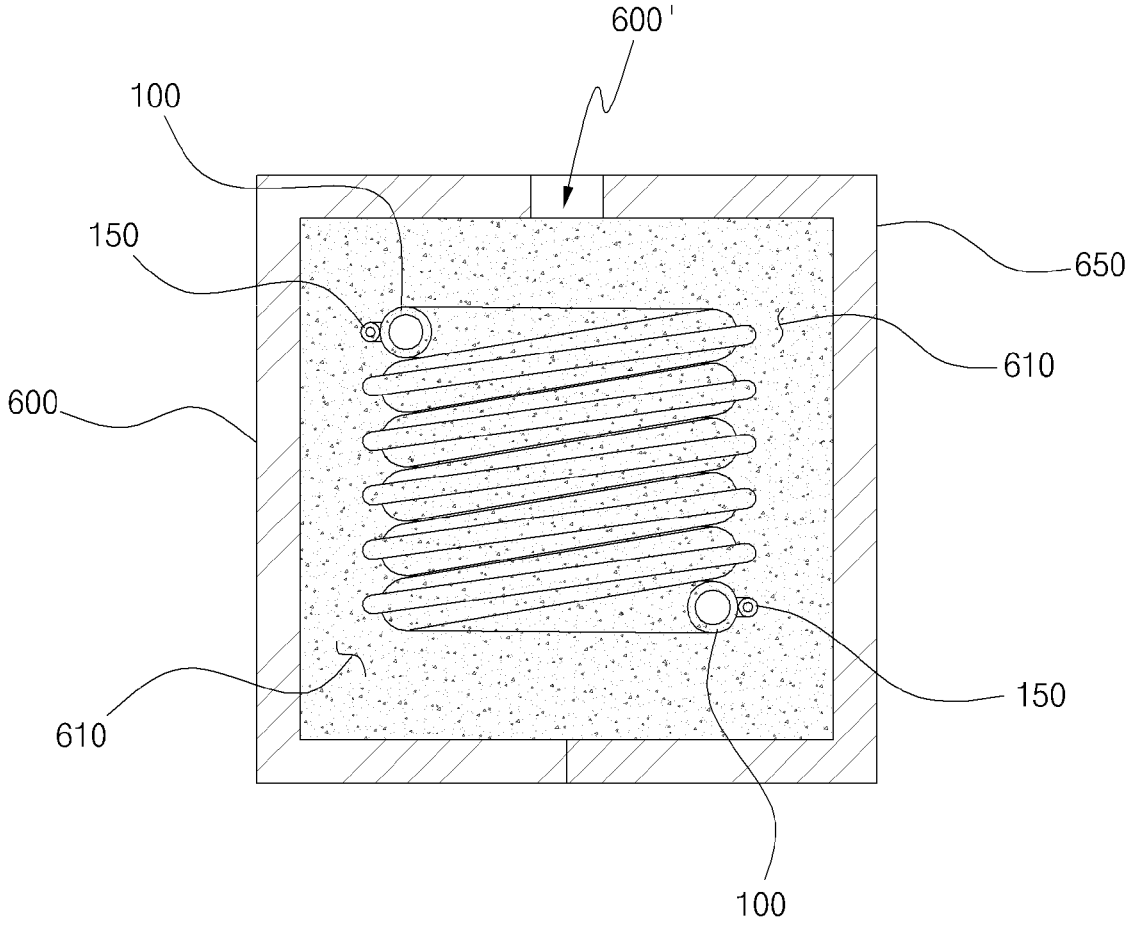
FIGS. 18 and 19 are conceptual diagrams showing a manufacturing process of the protection part of FIG. 17.
Figure 19:
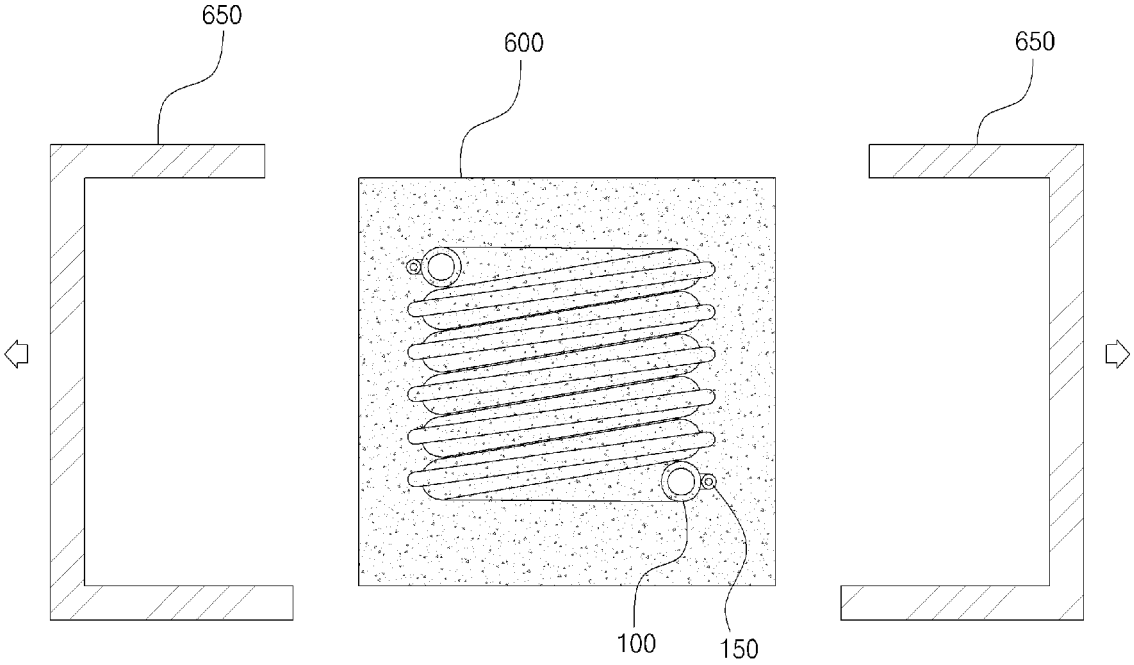
Figure 20:
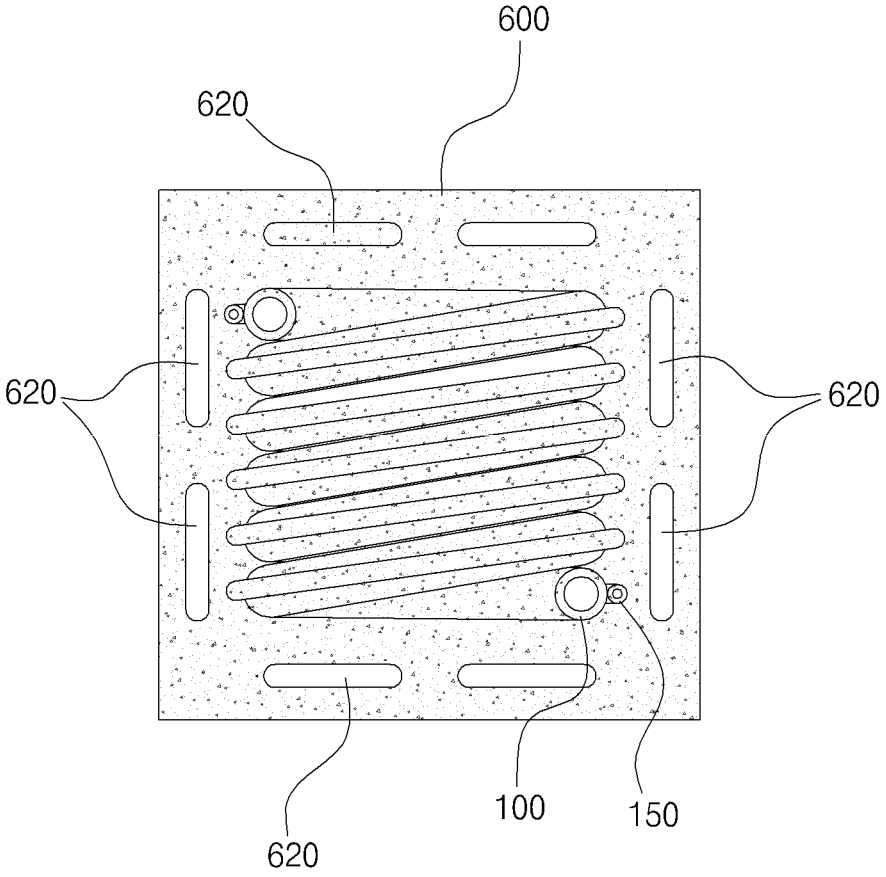
FIG. 20 is a view showing another example of the protection part.

FIG. 17 is a view showing a protection part is disposed on the outer circumferences of the feed pipe and the temperature control pipe of the hot and cold water dispenser according to the present invention, FIGS. 18 and 19 are conceptual diagrams showing a manufacturing process of the protection part of FIG. 17, and FIG. 20 is a view showing another example of the protection part.

First, referring to FIG. 17, a protection part 600 is mounted outside the feed pipe 100 and the temperature control pipe 150 of the hot and cold water dispenser according to the present invention.

The protection part 600 is molded to surround the feed pipe 100 and the temperature control pipe 150 in order to protect the feed pipe 100 and the temperature control pipe 150 from external physical and chemical shocks and to prevent that the cold or the heat is discharged to the outside. It is preferable that the inner face and the outer face of the protection part 600 are treated by anodizing or coated with anti-corrosive paints or with anti-corrosive resin.

Referring to FIGS. 17 to 19, the protection part 600 can be formed through the steps of putting the feed pipe 100 and the temperature control pipe 150 in a mold 650, injecting a casting material 600', such as aluminum or an alloy of aluminum, into a cavity 610 of the mold 650; and separating the mold 650. In this instance, the protection part 600 may further include a heat insulator 630 which surrounds the outer face of the protection part 600. The heat insulator 630, which surrounds the outer face of the protection part 600, serves to prevent that the cold or the heat is discharged to the outside during a heat transfer between the feed pipe 100 and the temperature control pipe 150.

Referring to FIG. 20, the protection part may further include heat transfer portions 620 disposed outside the feed pipe 100 and the temperature control pipe 150 to promote the heat transfer between the feed pipe 100 and the temperature control pipe 150.

The heat transfer portions 620 are arranged in such a way as to surround the feed pipe 100 and the temperature control pipe 150, and in order to heat water inside the feed pipe 100 through the temperature control pipe 150, the heat transfer portions 620 can be used as steam supply pipes for inducing a high temperature of steam by mounting heater rods (not shown) on the heat transfer portions 620 or by connecting steam pipes (not shown) to the heat transfer portions 620.

Furthermore, in order to cool water inside the feed pipe 100 through the temperature control pipe 150, the heat transfer portions 620 can be used as refrigerant pipes or can promote the cooling of the feed pipe 100 by the temperature control pipe 150 through an electronic cooling by mounting Peltier modules (not shown) to the heat transfer portions 620.

Figure 21:
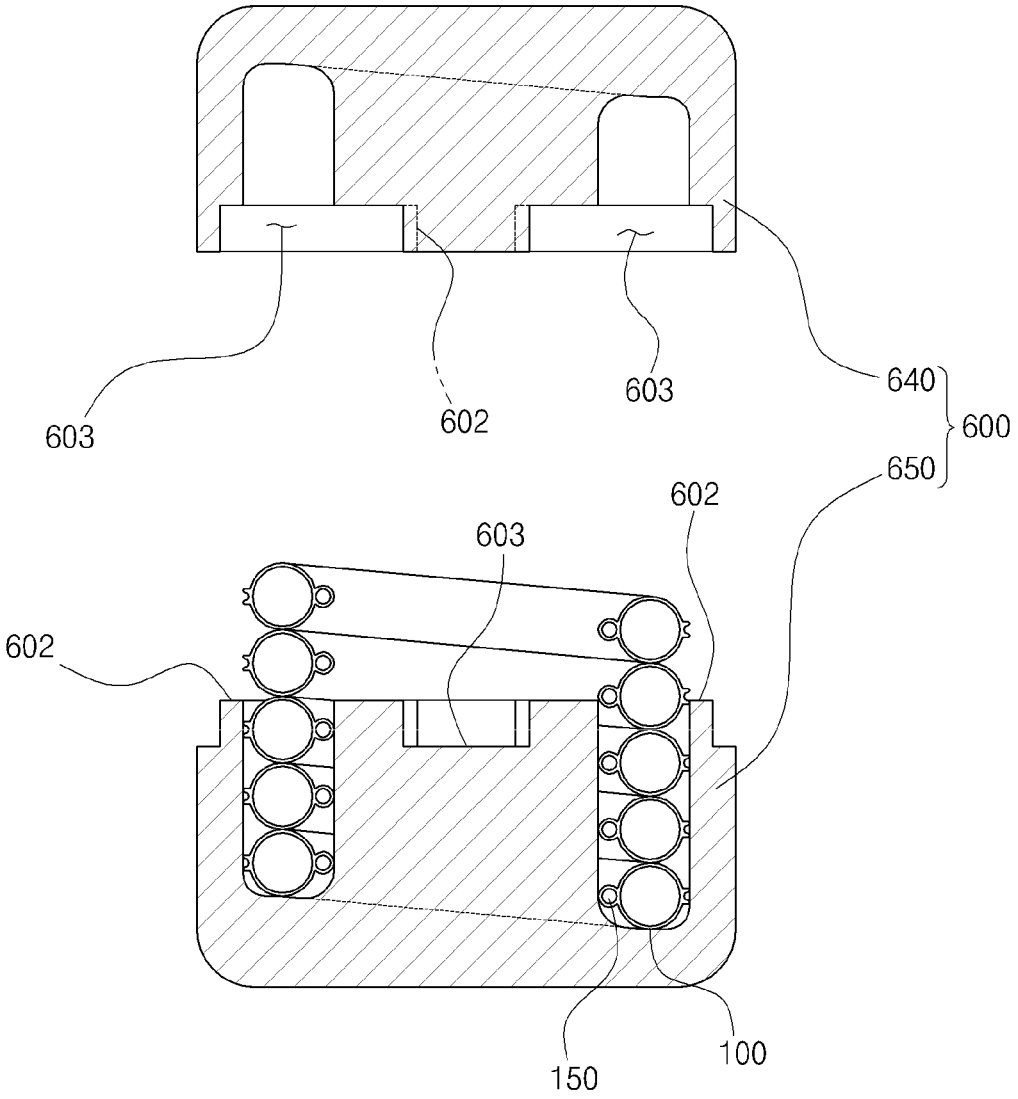
FIG. 21 is a view showing a further example of the protection part.
Figure 22:
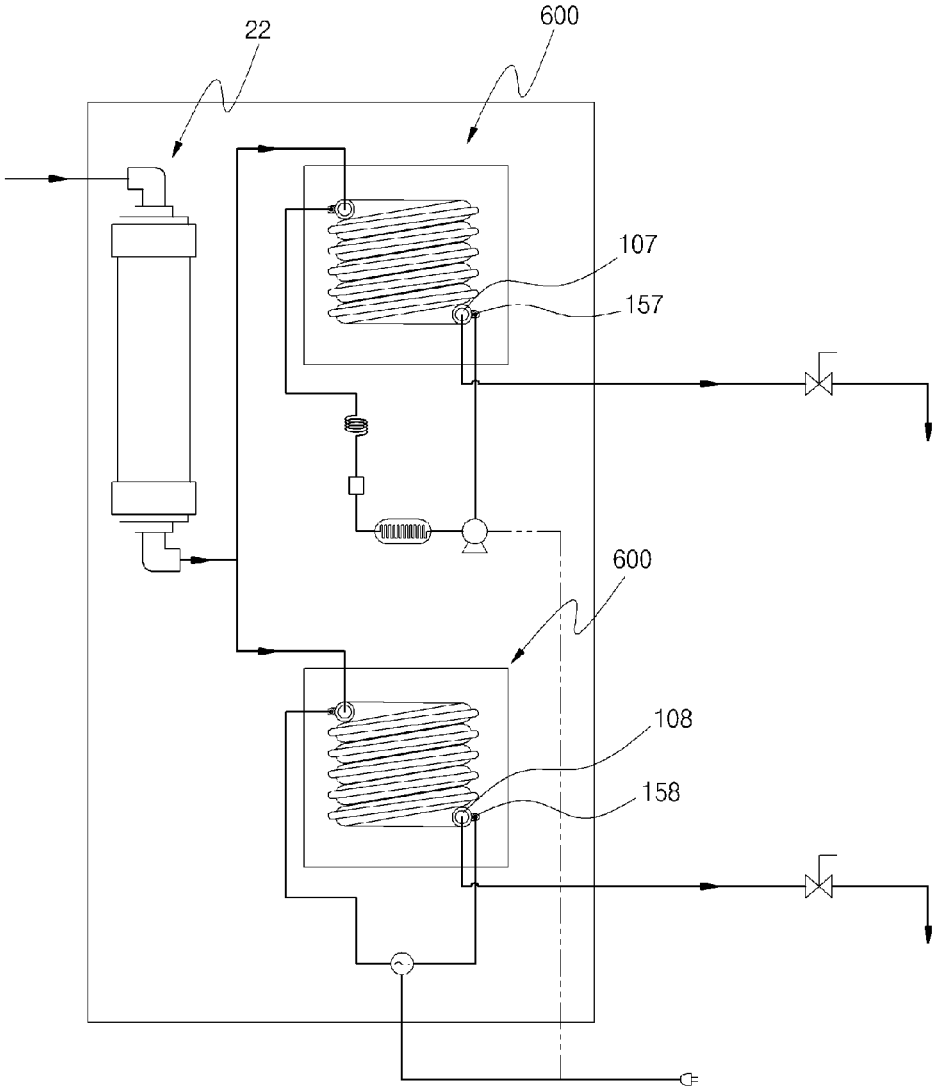
FIG. 22 is a systematic diagram of the hot and cold water dispenser having the protection part according to the present invention.

FIG. 21 is a view showing a further example of the protection part, and FIG. 22 is a systematic diagram of the hot and cold water dispenser having the protection part according to the present invention.

Referring to FIG. 21, the protection part 600 is divided into upper and lower parts in such a way as to be detachably joined with each other. In this instance, upper and lower cases 640 and 650 of the protection part respectively have projections 602 and recesses 603 that are consecutively formed on joined surfaces of the cases 640 and 650 and joined with each other. Therefore, the protection part illustrated in FIG. 21 allow the user to easily check defects of the feed pipe 100, the temperature control pipe 150 and various electric components and to easily replace them with new ones and repair them.

Referring FIG. 22, the hot and cold water dispenser includes a first temperature control pipe 157 formed integrally with a first feed pipe 107 along a longitudinal direction of the first feed pipe 107 to cool water inside the first feed pipe 107, and a second temperature control pipe 158 formed integrally with a second feed pipe 108 along a longitudinal direction of the second feed pipe 108 to heat water inside the second feed pipe 108, and in this instance, the first feed pipe 107 and the second feed pipe 108 are respectively surrounded by a protection part 600 and isolated from each other. As described above, refrigerant flows inside the first temperature control pipe 157 to cool water inside the first feed pipe 107, and for this, a refrigeration system is mounted. Additionally, the second temperature control pipe 158 includes heating means, such as a heater rod or steam, to heat water inside the second feed pipe 108. The refrigeration system and the heating means are known technologies, and hence, detailed descriptions thereof will be omitted.

Figure 23:
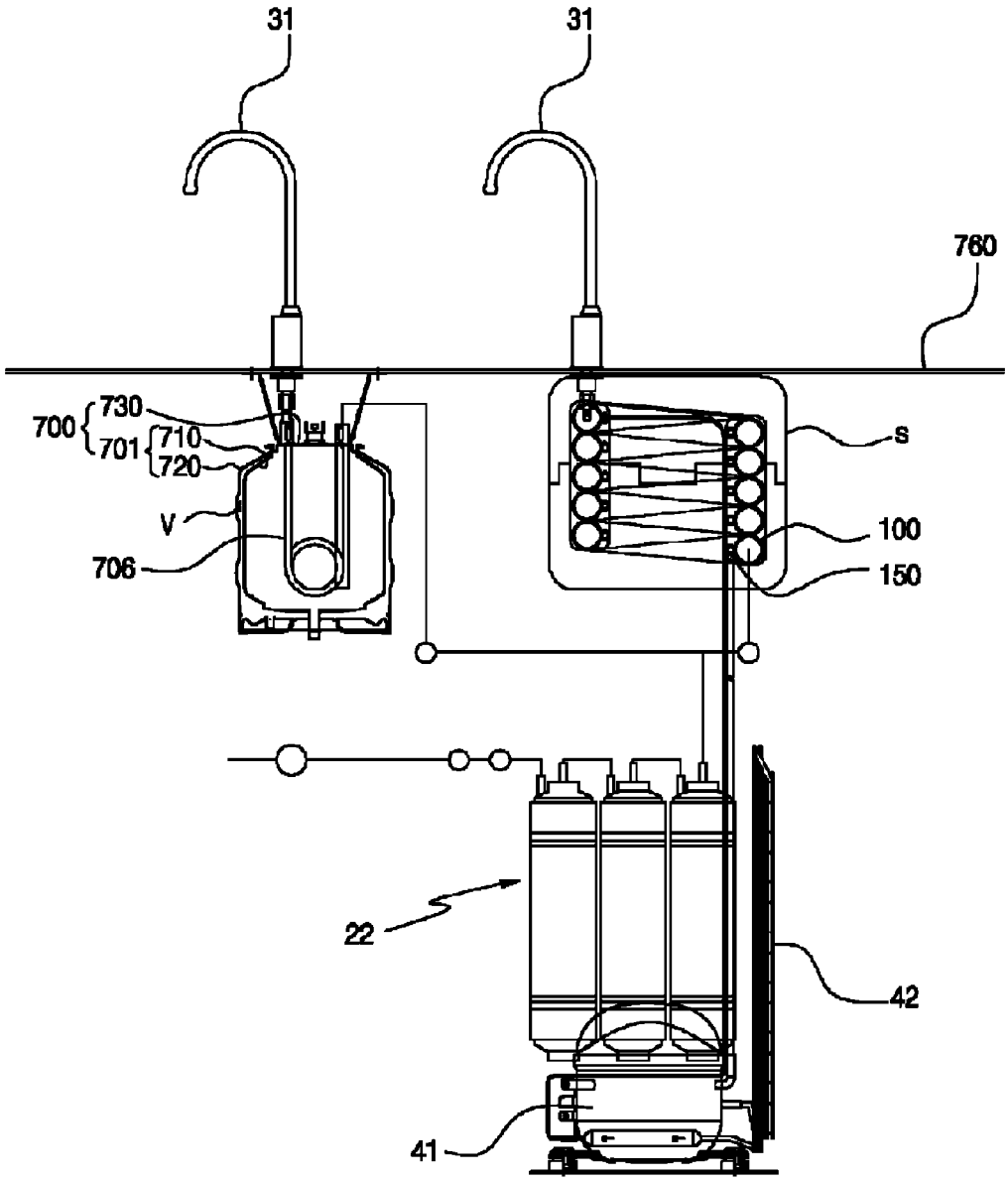
FIG. 23 is a view showing a state where a vacuum insulated water bath is mounted on the hot and cold water dispenser according to the present invention.
Figure 24:
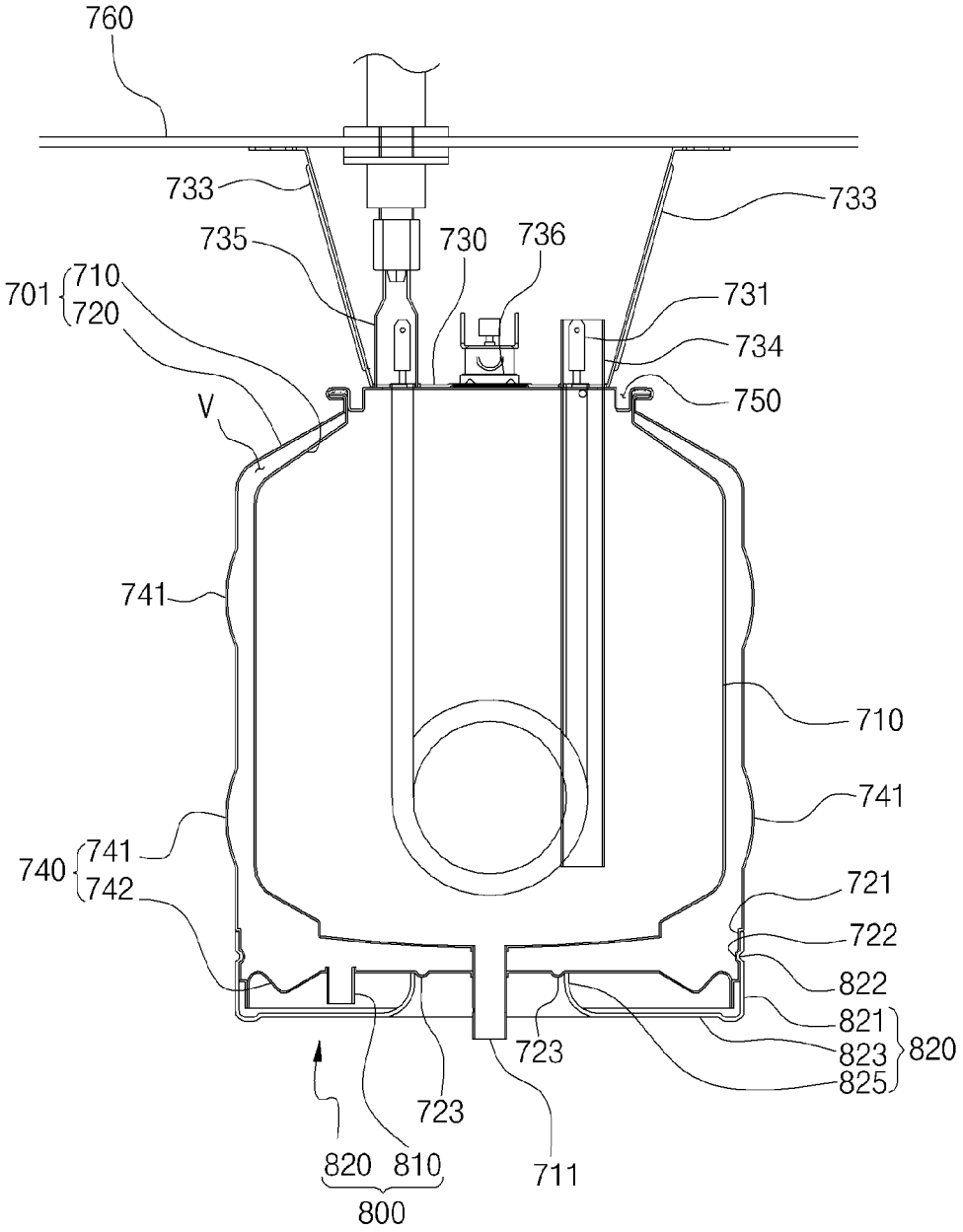
FIG. 24 is a view showing a detailed structure of the vacuum insulated water bath of FIG. 23.

FIG. 23 is a view showing a state where a vacuum insulated water bath is mounted on the hot and cold water dispenser according to the present invention, and FIG. 24 is a view showing a detailed structure of the vacuum insulated water bath of FIG. 23.

Referring to FIGS. 23 and 24, the hot and cold water dispenser according to the present invention includes a dual pipe having a feed pipe 100 and a temperature control pipe 150 and a vacuum insulated water bath 700 including a body part 701, which has an inner case 710 and an outer case 720. The feed pipe 100 and the temperature control pipe 150 can be achieved by one of the above embodiments of the present invention. Because the feed pipe and the temperature control pipe are described in the above, descriptions thereof will be omitted.

The vacuum insulated water bath 700 has a structure that the body part 701 having a vacuum space portion (V) formed between the inner case 710 for storing water therein and the outer case 720 is closed by a cover 730.

The vacuum insulated water bath 700 includes: a vacuum maintaining portion 800 disposed below the outer case 720 in such a way that a residual air of the vacuum space portion (V) is discharged out; and a pressure-resistant portion 740 disposed on the outer face of the outer case 720 for keeping the shapes of the inner case 710 and the outer case 720 when the residual air is discharged out.

The cover 730 is to close the body part 701, and as shown in the drawing, has a groove 750 of a ring shape hollowed down along the rim of the cover 730. Curing, filling of packing material (not shown), or welding is applied between a portion extending from the rim of the groove 750 and the rim of the body part 701 to firmly keep a sealed state.

In FIG. 24, the unexplained reference numeral 731 designates a terminal for connecting a heater 706 embedded in the inner case 710 with a power supply, 733 designates a fixed bracket for fixing the vacuum insulated water bath 700 to a sink 760, 734 designates an water inlet connected with the water purification filter 22 through a pipe, 735 designates a water outlet connected with an intake tube 820, and 736 designates a temperature sensor.

In order to prevent that electric components, such as the terminal 731 and the temperature sensor 736, mounted on the upper face of the cover 730 are not in contact with water even though water is leaked, it is preferable that sealability between the rim of the groove 750 and the rim of the body part 701 is kept and the electric components are located higher than the upper face of the cover 730 where they are mounted.

In the meantime, the pressure-resistant portion 740 is provided to prevent transformation of the inner case 710 and the outer case 720 due to pressure imbalance between the inside and the outside of the vacuum space portion (V) while the residual air is discharged out to keep the vacuum state of the vacuum space portion (V) through the vacuum maintaining portion 800, which will be described later, and to improve a structural strength of the inner case 710 and the outer case 720.

As shown in FIG. 24, at least one first projection ring 741 formed on the outer face of the outer case 720 in a ring shape along the outer circumferential surface of the outer case 720 in a vertical direction, and a second projection ring 742 is disposed on the bottom surface of the outer case 720 whose center is penetrated by a drain pipe 711 extending from the bottom center of the inner case 710, and at least one second projection ring 742 is formed around the drain pipe 711 in a concentric circle.

The first and second projection rings 741 and 742 are disposed on the outer circumferential surface and the bottom surface of the outer case 720 based on the fact that panels having an increased area through a projection structure of a wrinkled structure is higher in structural strength per unit area than smooth and flat panels.

Meanwhile, as described above, the vacuum maintaining portion 800 is constructed to keep the vacuum state of the vacuum space portion (V) by discharging out the residual air inside the vacuum space portion (V), and includes an air discharge pipe 810 and a protective cover 820.

The air discharge pipe 810 is formed on the bottom face of the outer case 720 and communicates with the vacuum space portion (V), and the protective cover 820 is detachably joined to the lower portion of the outer case 720 to protect the air discharge pipe 810. That is, minimization of thermal conductivity of the body part 701 to continuously keep an insulation effect is crucial to the vacuum maintaining portion 800, and hence, for this, the vacuum maintaining portion 800 is provided to make the space portion (V) in a vacuum state.

Referring to FIG. 24, after the residual air in the vacuum space portion (V) is discharged out through the air discharge pipe 810, the air discharge pipe 810 is sealed by a separate closing member (not shown), and then, the protective cover 820 is provided to protect the air discharge pipe 810.

Here, the protective cover 820 includes: a case wall 821 detachably joined to the outer face of the lower portion of the outer case 720, a bottom face 823 that extends from the edge of the lower end portion of the case wall 821 toward the drain pipe 711 extending from the bottom center of the inner case 710 and is penetrated at the center thereof, and a contact horn 825 that extends from the edge of the penetrated center of the bottom face 823 toward the bottom face of the outer case 720 and is in contact with the bottom face of the outer case 720.

That is, the protective cover 820 has a structure that it can be detachably mounted when there is a need to discharge out the residual air inside the vacuum space portion (V) through the air discharge pipe 810 using a vacuum pump when the vacuum state of the vacuum space portion (V) is lessened due to a long-term use. In this instance, the edge of an end portion of the contact horn 825 is closely fixed to a contact ring projection 733 that projects in a ring shape around the drain pipe 711 from the bottom face of the outer case 720.

The structure of the protective cover 820 will be described in more detail. The protective cover 820 is detachably joined to a tiered jaw portion 721 formed along the outer surface of the lower portion of the outer case 720. That is, the protective cover 820 has a first retaining ring groove 822 recessed toward the tiered jaw portion 721 along the outer circumferential surface of the case wall 821, and the tiered jaw portion 721 has a second retaining ring groove 722 recessed toward the inner case 710 at a position corresponding to the first retaining ring groove 822, so that the first and second retaining ring grooves 822 and 722 are sealably joined to each other.

Figure 25:
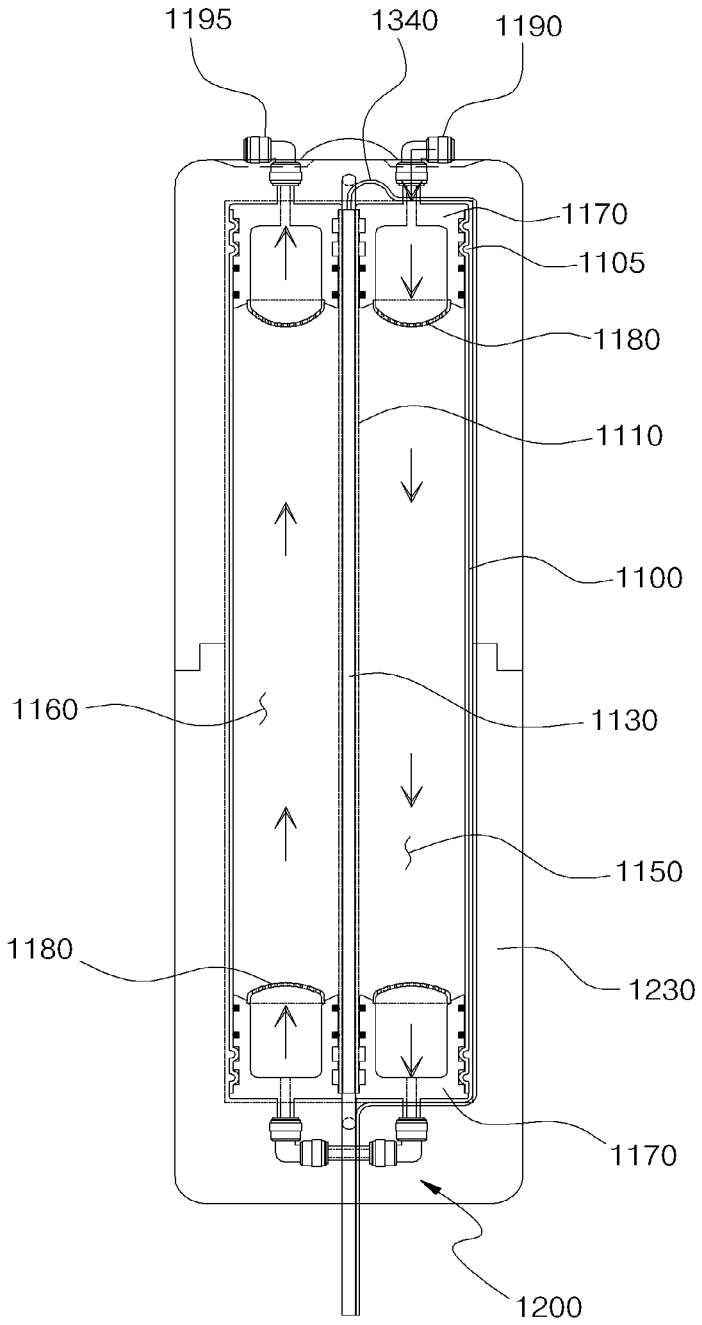
FIG. 25 is a front sectional view of a cold water tank of a hot and cold water dispenser according to another preferred embodiment of the present invention.
Figure 26:
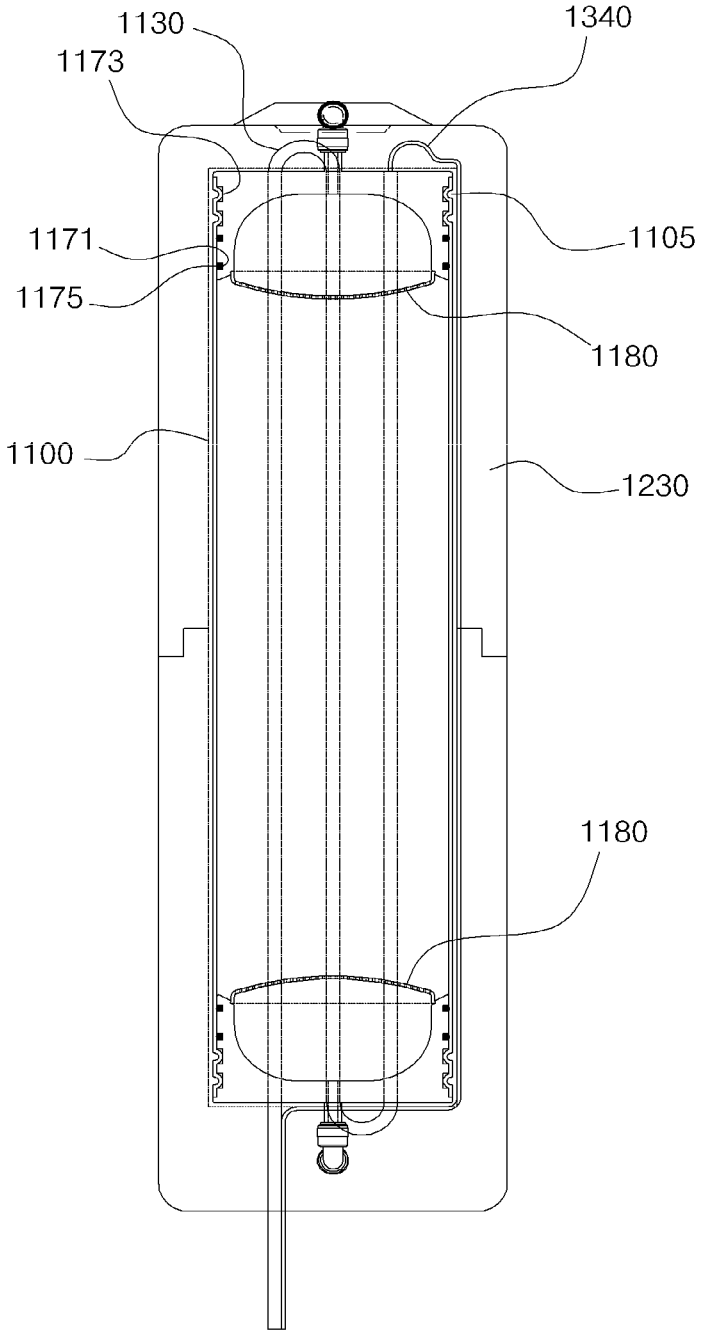
FIG. 26 is a side sectional view of the cold water tank of FIG. 25.
Figure 27:
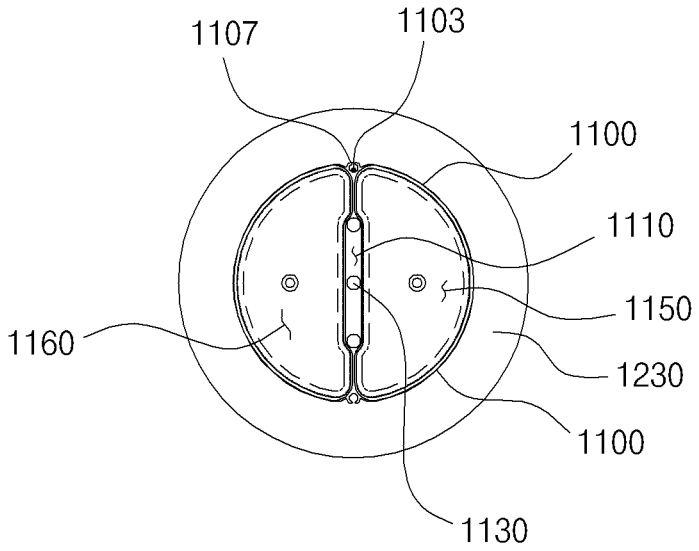
FIG. 27 is a top sectional view of the cold water tank of FIG. 25.

FIG. 25 is a front sectional view of a cold water tank of a hot and cold water dispenser according to another preferred embodiment of the present invention, FIG. 26 is a side sectional view of the cold water tank of FIG. 25, and FIG. 27 is a top sectional view of the cold water tank of FIG. 25.

Referring to FIGS. 25 to 27, the hot and cold water dispenser according to the present invention includes a cold water tank 1100 and a refrigeration system 1300, wherein the cold water tank 1100 has a pipe receiving part 1110 formed therein, and a cooling pipe 1130 of the refrigeration system 1300 is disposed on the pipe receiving part 1110 and mounted inside the cold water tank 1100.

The cold water tank 1100 is a space for cooling and storing purified water and is generally in a cylindrical form. However, the cold water tank 110 is not restricted to the cylindrical form but may be a hexahedron or a polyhedron if necessary, and the structure of the cold water tank 1100 may be changed in various ways according to used environments. However, for convenience in description, in the present invention, the cylindrical cold water tank 1100 will be described.

The inside of the cold water tank 1100 is divided into two sides in a longitudinal direction, wherein one side of the cold water tank 1100 has a first compartment 1150 and the other side has a second compartment 1160. The first and second compartments 1150 and 1160 respectively have a semicircular section and also have hollow portions therein. The first compartment 1150 and the second compartment 1160 are disposed in such a way that their flat surfaces are opposed to each other, and the pipe receiving portion 1110 is mounted on the opposed surfaces of the first compartment 1150 and the second compartment 1160 in the longitudinal direction. The pipe receiving portion 1110 will be described in more detail. The flat surfaces of the first compartment 1150 and the second compartment 1160 are partly hollowed, and the pipe receiving portion 1110 of a slot form that traverses the central portion of the cold water tank 1100, is elongated along the longitudinal direction, and has a narrow and long section, is formed on the opposed surfaces of the first compartment 1150 and the second compartment 1160. The cooling pipe 1130 is mounted inside the pipe receiving portion 1110 in such a way that the cooling pipe 1130 is overlapped at least once inside the pipe receiving portion 1110 in the longitudinal direction or in a width direction. The cooling pipe 1130 will be described in more detail later.

The cold water tank 1100 having the above structure has the first compartment 1150 and the second compartment 1160, which are separately molded, and the first compartment 1150 and the second compartment 1160 are inserted into the cold water tank 110 or directly joined with each other. However, in a preferred embodiment of the present invention, the cold water tank 110 is constructed of the first compartment 1150, the second compartment 1160, and the pipe receiving portion 1110, which are extrusion-molded integrally. Meanwhile, at least one combining projection 1105 is formed on a wall surface adjacent to both ends of the first compartment 1150 and the second compartment 1160. The combining projection 1105 is formed by a portion of the wall of the compartment 1150 or 1160 inwardly bent, and an end piece 1170, which will be described later, is combined and fixed to the cold water tank 1100 by the combining projection 1105. Moreover, it is preferable that the inner surface and the outer surface of the cold water tank 110 are treated by anodizing or coated with anticorrosive paints.

The combination relationship between the cold water tank 1100 and the end piece 1170 will be described in more detail later.

The cold water tank 1100 has a temperature sensor 1103 to periodically measure temperature of water introduced into the cold water tank 1100. The water introduced into the cold water tank 1100 is cooled by the refrigeration system 1300, which will be described later. In this instance, if temperature water inside the cold water tank 1100 is below a predetermined temperature, it is necessary to stop the operation of the refrigeration system 1300 to prevent unnecessary waste of electric power and to prevent freezing of water inside the cold water tank 1100. The temperature sensor 1103 may be disposed inside the cold water tank 1100, but it is preferable that the temperature sensor 1103 is disposed on the outer face of the cold water tank 1100 because water always flows inside the cold water tank 1100. The cold water tank 1100 can keep temperature of cold water uniform even though the refrigeration system 1300 is controlled on the basis of the outside temperature of the cold water tank 1100 because it keeps thermal equilibrium with water flowing inside the cold water tank 1100.

The temperature sensor 1103 may be disposed at a certain position of the outer face of the cold water tank 1100, but preferably, a sensor receiving portion 1107 is disposed at a position where the first compartment 1150 and the second compartment 1160 meet each other and the temperature sensor 1103 is disposed in the sensor receiving portion 1107. As described above, the first compartment 1150 and the second compartment 1160 are in a semicircular form and injection-molded. Therefore, a point where a plane surface and a curved surface of each of the compartments 1150 and 1160 meet each other has a curved surface because of the nature of injection-molding, and hence, it is easy to form a predetermined space. Accordingly, if the sensor receiving portion 1107 is disposed at the point where the first compartment 1150 and the second compartment 1160 meet each other and the temperature sensor 1103 is disposed in the sensor receiving portion 1107, the temperature sensor 1103 can be protected and the space can be effectively utilized. In this instance, the sensor receiving portion 1107 may adopt any shape if the temperature sensor 1103 can be accommodated therein, and it is preferable that a part of the sensor receiving portion 1107 can be opened outward and the temperature sensor 1103 is detachably mounted so that the temperature sensor 1103 can be easily replaced or repaired when it is out of order or malfunctions.

Both ends of the first compartment 1150 and the second compartment 1160 are sealed to form a space for storing purified water therein. Concretely, the end piece 1170 that has a shape corresponding to the shape of the first compartment 1150 and the second compartment 1160 is joined to both ends of the first compartment 1150 and the second compartment 1160 of the cold water tank 1100 to seal the ends of the compartments 1150 and 1160. The end piece 1170 disposed on one end of the first compartment 1150 has a water inlet 1190 and the end piece 1170 disposed on one end of the second compartment 1160 has a water outlet 1195, and the other end of the first compartment 1150 and the other end of the second compartment 1160 are connected to the outside by a communication pipe 1200.

The end piece 1170 has a tube-shaped body section corresponding to a shape of the section of the first compartment 1150 or the second compartment 1160 and a U-shaped side section because sides of the end piece 1170 are sealed. If necessary, the end piece 1170 may be not in the tube shape but in a block shape whose inside is filled, but the end piece 1170 of the tube shape has advantages in that the end piece 1170 can be easily combined with the cold water tank 1100, maximize the volume of water stored in the cold water tank 1100, and allow an ice net 1180 to be easily mounted thereto.

The end piece 1170 includes at least one O-ring joining groove 1171 and at least one case joining groove 1173 formed on the outer circumferential surface thereof. In this instance, as a preferred embodiment of the present invention, the O-ring joining groove 1171 is disposed adjacent to an open portion of the end piece 1170 and the case joining groove 1173 is disposed adjacent to a sealed portion. An O-ring 1175 is joined to the O-ring joining groove 1171 to prevent discharge of water of the cold water tank 110 to the outside in the case that the end piece 1170 is joined to the cold water tank 1100, and the combining projection 1105 is inserted into the case joining groove 1173 so that the end piece 1170 can be firmly fixed to the both ends of the compartments.

The water inlet 1190 disposed at one end of the first compartment 1150 has a known pipe or connection tube, such as a straight pipe or an elbow, is a flow path for introducing water supplied through a water purification filter 1380 into the first compartment 1150. The water outlet 1195 disposed at one end of the second compartment 1160 is a flow path for supplying cold water stored in the cold water tank 1100 to where it is needed, and has a know pipe or connection tube like the water inlet 1190. In this instance, the water inlet 1190 and the water outlet 1195 may be joined with an additional pipe or may be molded integrally with the end piece 1170.

Meanwhile, the other end of the first compartment 1150 and the other end of the second compartment 1160 are connected with each other by the communication pipe 1200, so that water introduced into the first compartment 1150 through the water inlet 1190 can flow into the second compartment 1160 through the communication pipe 1200 and be discharged out through the water outlet 1195. As shown in the drawing, the communication pipe 1200 may be formed by a pair of elbows joined with each other, but is not restricted to the above, and can be formed by combination of known pipes or connection pipes of various shapes, such as curved pipes or U-shaped pipes.

The ice net 1180 is disposed inside the both ends of the first compartment 1150 and the second compartment 1160. The ice net 1180 prevents that ice generated in the first compartment 1150 moves to the second compartment 1160, or that ice generated in the first compartment 1150 or the second compartment 1160 is discharged out from the cold water tank 110 or introduced into the cold water tank 1100. The cooling pipe 1130 disposed in the pipe receiving portion 1110 rapidly lowers surrounding temperature while refrigerant is evaporated. Especially, because a portion of the pipe receiving portion 1110 having an expansion valve (not shown) is the lowest in temperature, freezing partly occurs at some ends of the first compartment 1150 and the second compartment 1160 along the wall surface thereof. The ice formed on the wall surface of the compartments can easily come off when the refrigeration system 1300 is stopped. Accordingly, the ice nets 1180 disposed at both ends of the first and second compartments 1150 and 1160 prevents that the ice floats around inside the compartments or is discharged to the outside. The ice nets 1180 may be disposed on the wall surfaces of the first and second compartments 1150 and 1160, but it is preferable that the ice nets 1180 are disposed on the opposite side of the end piece 1170 where the open portion is disposed, as shown in the drawing.

The cold water tank 1100 has a heat insulator 1230 disposed on the outer face thereof to prevent loss of the cold by the outside heat introduced into the cold water tank 1100. Heat insulators 1230 are mounted not only on the outer circumference of the cold water tank 1100 but also on both ends thereof to thereby surround the whole outer surface of the cold water tank 1100. The heat insulators 1230 are known heat insulators made of Styrofoam or a foaming agent.

Figure 28:
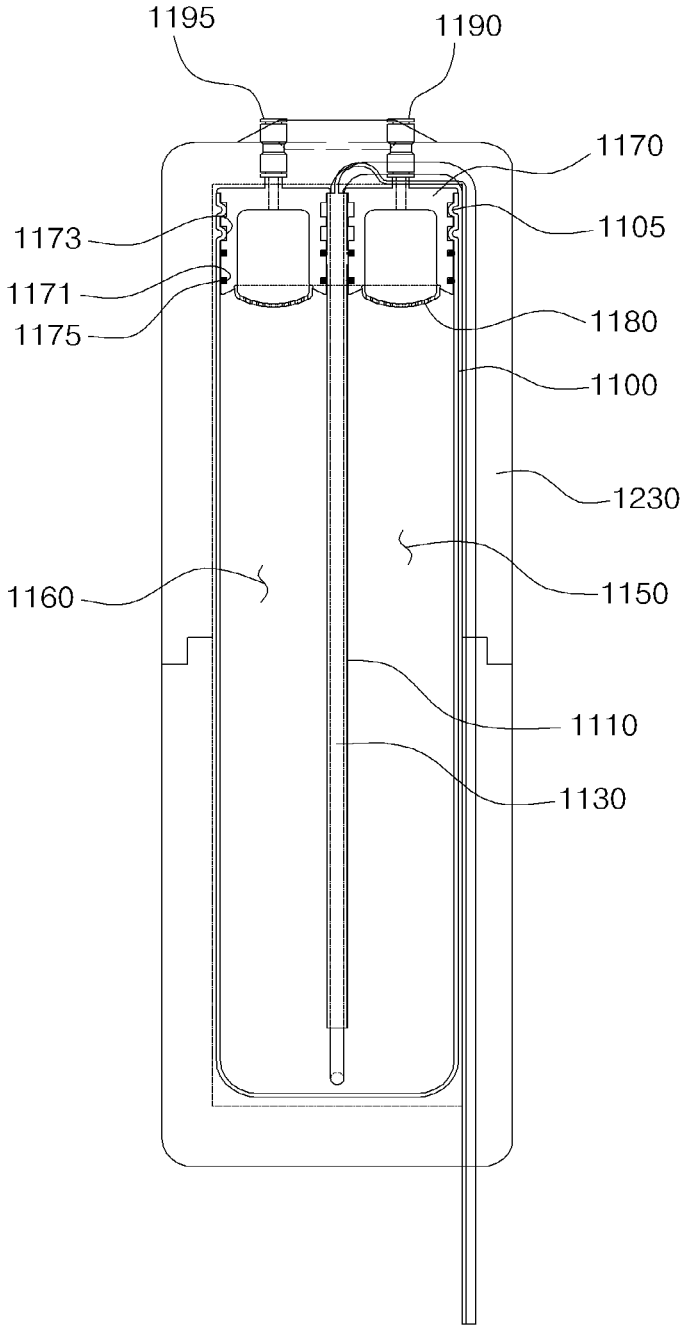
FIG. 28 is a view showing another structure of the cold water tank.
Figure 29:
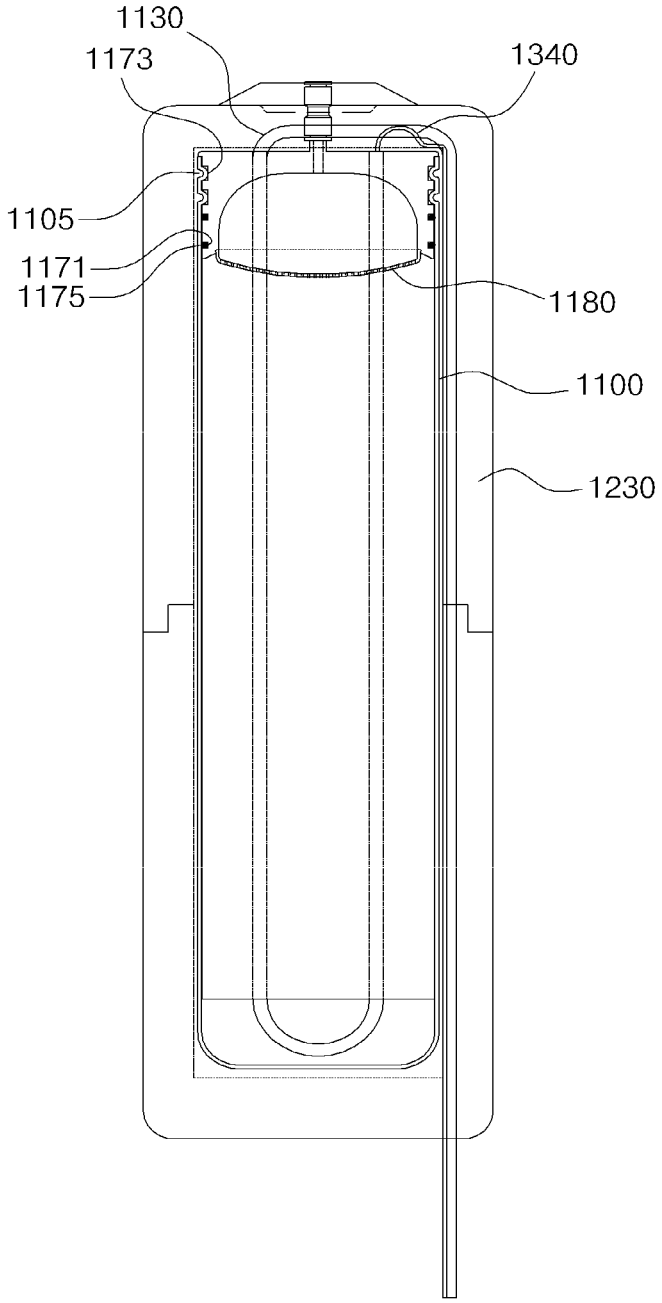
FIG. 29 is a side sectional view of the cold water tank of FIG. 28.
Figure 30:
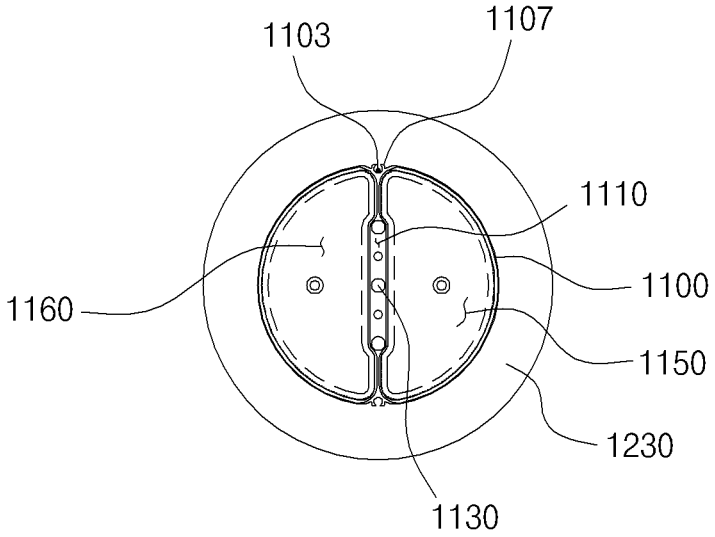
FIG. 30 is a top sectional view of the cold water tank of FIG. 28.

FIG. 28 is a view showing another structure of the cold water tank, FIG. 29 is a side sectional view of the cold water tank of FIG. 28, and FIG. 30 is a top sectional view of the cold water tank of FIG. 28.

Referring to FIGS. 28 to 30, a cold water tank 1100 of the hot and cold water dispenser according to another preferred embodiment of the present invention includes: first and second compartments 1150 and 1160 that are opposed to each other, both ends of the first and second compartments 1150 and 1160 being sealed, wherein the first compartment 1150 has a water inlet 1190 disposed at one end thereof and the second compartment 1160 has a water outlet 1195 disposed at one end thereof; and a pipe receiving portion 1110 disposed along a longitudinal direction of the opposed faces of the first and second compartments 1150 and 1160, wherein the pipe receiving portion 1110 is spaced apart from the other ends of the first and second compartments 1150 and 1160 in such a way that the other ends of the first and second compartments 1150 and 1160 communicate with each other.

In this embodiment, the cold water tank 1100 of the hot and cold water dispenser is characterized in that the pipe receiving portion 1110 is spaced apart from the other ends of the first and second compartments 1150 and 1160, namely, from the other end of the cold water tank 1100, so that the ends of the first and second compartments 1150 and 1160 communicate with each other inside the cold water tank 1100. In comparison of the cold water tank 1100 illustrated in FIGS. 28 to 30 (hereinafter, called 'the second embodiment') with the cold water tank 1100 illustrated in FIGS. 25 to 27 (hereinafter, called 'the first embodiment'), the first compartment 1150 and the second compartment 1160 of the first embodiment are completely separated from each other inside the cold water tank 1100 and connected with each other through the communication pipe 1200 outside the cold water tank 1100. Such a structure of the first embodiment has several advantages in that it can lower temperature of cold water discharged through the water outlet 1195 because the pipe receiving portion 1110 completely separates the first compartment 1150 from the second compartment 1160 to prevent exchange of water inside the cold water tank 110 and in that it can enhance cooling efficiency because the pipe receiving portion 1110 can be formed longer and wider. However, the structure of the first embodiment has a problem in that its volume is increased because the communication pipe 1200 is additionally mounted. Moreover, the structure of the first embodiment has another problem in that it is difficult to install because the heat insulator 1230 is formed corresponding to the shape of the communication pipe 1200 or the communication pipe 1200 is surrounded by the additional heat insulator 1230. Furthermore, according to circumstances, if the heat insulator 1230 is not disposed on the communication pipe 120, a loss of the cold may occur. In order to overcome the above problems of the first embodiment, the cold water tank 1100 according to the second embodiment of the present invention is spaced apart from the end of the cold water tank 1100 at a predetermined interval in such a way that the first compartment 1150 and the second compartment 1160 communicate with each other inside the cold water tank 1100. The structure of the cold water tank 1100 of the hot and cold water dispenser according to the second embodiment of the present invention is the same as the cold water tank 1100 of the first embodiment, excepting the connection structure of the first compartment 1150 and the second compartment 1160 of the cold water tank 1100, and hence, detailed description thereof will be omitted.

Figure 31:
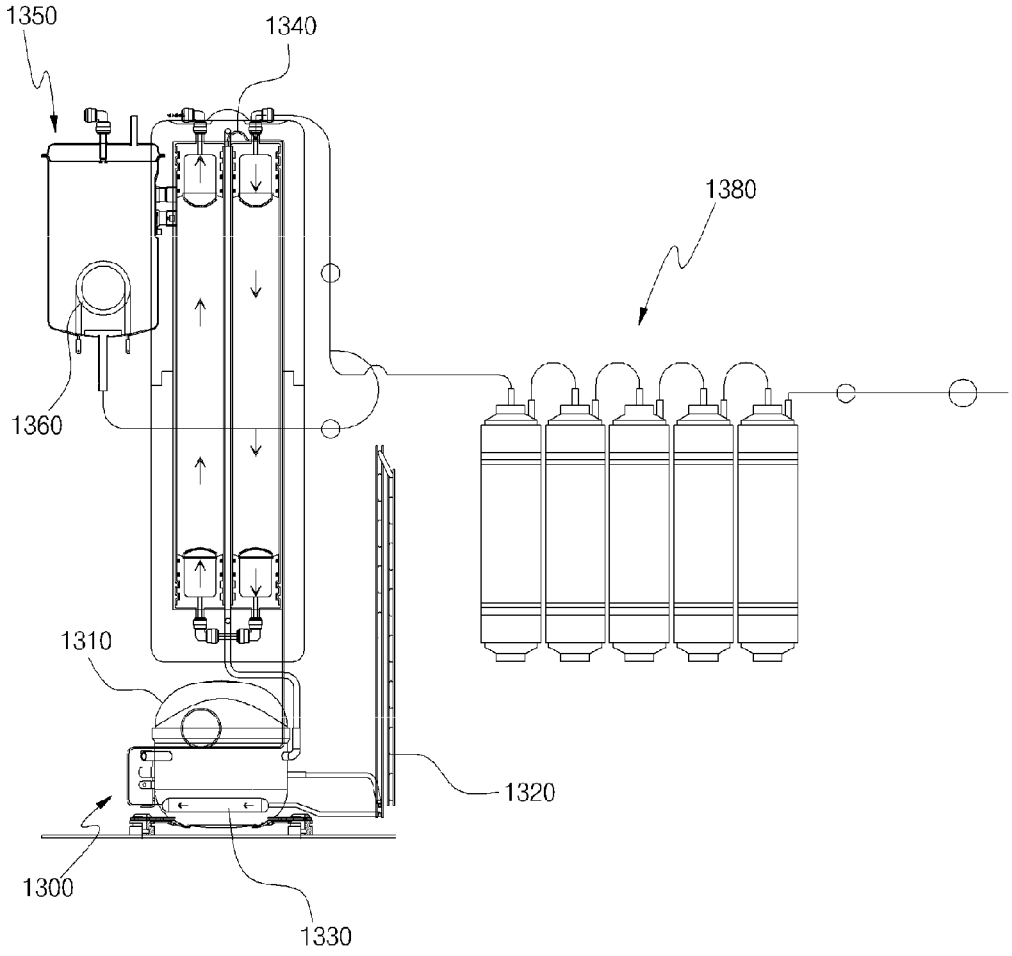
FIG. 31 is a schematic diagram showing a state where a refrigeration system is joined to the cold water tank of the hot and cold water dispenser according to the present invention.

FIG. 31 is a schematic diagram showing a state where a refrigeration system is joined to the cold water tank of the hot and cold water dispenser according to the present invention.

Referring to FIG. 31, the hot and cold water dispenser according to the present invention is combined with a known refrigeration system 1300 to carry out a cooling action, and includes a hot water tank 1350 and a heater 1360 mounted inside the hot water tank 1350 for heating water introduced into the hot water tank 1350.

The refrigeration system 1300 includes a compressor 1310, a condenser 1320, and an evaporator. The compressor 1310 compresses refrigerant into a saturate vapor state, the condenser 1320 radiates heat from the refrigerant discharged from the compressor 1310 and converts it into a saturated liquid of a low-temperature and high-pressure, and the evaporator includes an expansion valve and a cooling pipe 1130 and adiabatically expands the refrigerant supplied from the condenser 1320 through the expansion valve to lower temperature around the cooling pipe 1130. Moreover, the refrigeration system 1300 further includes a drier 1330 for removing foreign matters contained in the refrigerant converted into the saturated liquid while passing through the condenser 1320. In the cold water tank 110 of the hot and cold water dispenser according to the present invention, the cooling pipe 1130 of the evaporator is disposed inside the pipe receiving portion 1110 formed between the first compartment 1150 and the second compartment 1160 of the cold water tank 1100 in such a way as to be overlapped at least once inside the pipe receiving portion 1110. In this instance, it is preferable that the cooling pipe 1130 is mounted along the longitudinal direction of the pipe receiving portion 1110.

The refrigerant converted into the liquid state by the condenser 1320 is supplied to the cooling pipe 1130 of the pipe receiving portion 1110 through a capillary tube 1340. The refrigerant reaching the cooling pipe 1130 is adiabatically expanded by the expansion valve and lowers temperature of the pipe receiving portion 1110 and the first and second compartments 1150 and 1160, which are oppositely disposed on the pipe receiving portion 1110. Accordingly, water introduced into the cold water tank 1100 through the water inlet 1190 is cooled and discharged out through the water outlet 1195.

In the meantime, the cold water tank 1100 further includes a water purification filter 1380 for purifying water supplied from a raw water pipe (not shown) and supplying the purified water to the cold water tank 1100 or the hot water tank 1350. Because the water purification filter 1380 is well-known, and hence, the detailed description thereof will be omitted.

The hot and cold water dispenser according to the present invention can use not only the cold water tank 1100 but also the hot water tank 1350. The hot water tank 1350 has a cylindrical or polygonal body and a heater 1360 mounted inside the body for heating water introduced into the hot water tank 1350 from the raw water pipe or the water purification filter 1380 up to an appropriate temperature, and the heated water is supplied to the user as water for living or as drinking water. The hot water tank 1350 may adopt one of various known structures, and hence, the detailed description thereof will be omitted.

Figure 32:
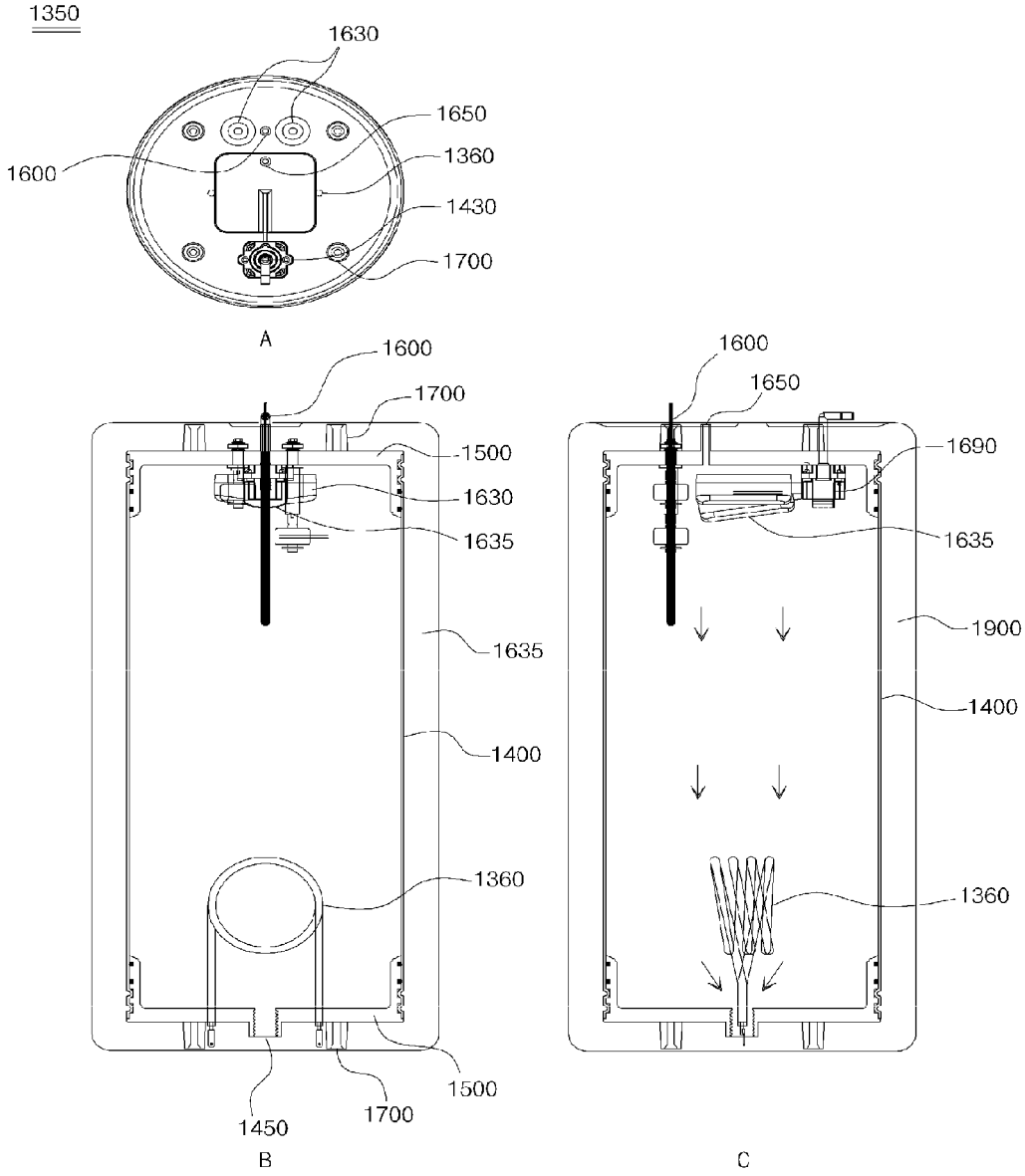
FIG. 32 is a view showing a detailed construction of a hot water tank of FIG. 31.
Figure 33:
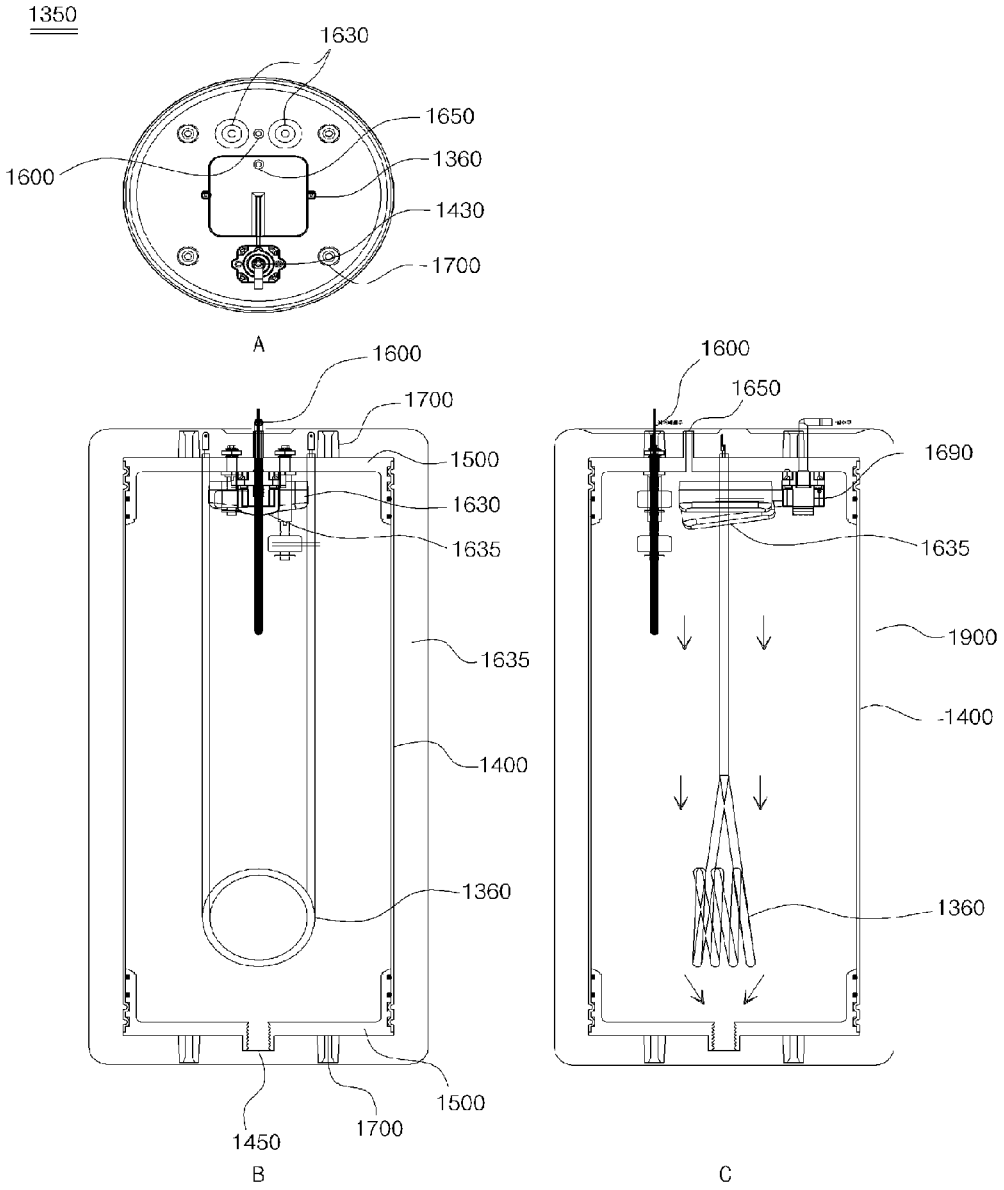
FIG. 33 is a view showing another example of the hot water tank of FIG. 31.

FIG. 32 is a view showing a detailed construction of a hot water tank of FIG. 31, and FIG. 33 is a view showing another example of the hot water tank of FIG. 31.

In FIGS. 32 and 33, FIGS. 32(A) and 33(A) are top sectional views, FIGS. 32(B) and 33(B) are side sectional views, and FIGS. 32(C) and 33(C) are other side sectional views of the hot water tank.

The hot water tank 1350 includes: a storage tank 1400 for storing water; a heater 1360 mounted inside the storage tank 1400; a heat insulator 1900 mounted outside the storage tank 1400; hot water tank end pieces 1500 disposed at both ends of the storage tank 1400; and a temperature sensor 1600, a water level sensor 1630 and an air outlet 1650 disposed on the hot water tank end pieces 1500.

The storage tank 1400 is in a cylindrical or polygonal shape and the hot water tank end pieces 1500 are mounted at both ends of the storage tank 1400. In this instance, the detailed combination method and structure of the hot water tank end pieces 1500 and the storage tank 1400 are similar to the end pieces 1170 of the cold water tank 1100 illustrated in FIGS. 25 to 30, and hence, the detailed descriptions thereof will be omitted.

The end piece 1500 has the temperature sensor 1600, the water level sensor 1630, and the air outlet 1650, the hot water tank end piece 1500 mounted on one side of the storage tank 1400 has a first tank hole 1430 serving as a water inlet, and the hot water tank end piece mounted on the other side of the storage tank 1400 has a second tank hole 1450 serving as a water outlet. The tank holes 1430 and 1450 may be formed on the contrary to the above if necessary. That is, the second tank hole 1450 is formed on the hot water tank end piece 1500 mounted on one side of the storage tank 1400 and the first tank hole 1430 is formed on the hot water tank end piece 1500 mounted on the other side of the storage tank 1400.

Additionally, the temperature sensor 1600, the water level sensor 1630, the air outlet 1650, and the heater 1360 are respectively mounted on the inner surface of the hot water tank end piece 1500. In this instance, it is preferable that the heater 1360 is mounted on the hot water tank end piece 1500 having the second tank hole 1450 to enhance heating efficiency (see FIG. 32), but the heater 1360 may be mounted on the hot water tank end piece 1500 having the first tank hole 1430 (see FIG. 33). Moreover, the air outlet 1650 and the water level sensor 1630 are mounted on the hot water tank end piece 1500, which is located on the upper portion of the hot water tank 1350, in consideration of the installation direction of the hot water tank 1350 in order to smoothly discharge the inside air of the storage tank 1400 and to easily measure the water level. For the temperature sensor 1600, one of various kinds of known temperature sensors may be used. Furthermore, also the water level sensor 1630 may adopt one of various kinds of known water level sensors, but preferably, the water level sensor 1630 having a ball tap 1635, which moves according to a change of the water level to measure the water level, as shown in the drawing.

Meanwhile, a fixed bracket 1700 is mounted at one of ends of the hot water tank 1350 and joined to the heat insulator 1900, so that the heat insulator 1900 can be firmly combined to the outer face of the hot water tank 1350 to thereby prevent that the heat of water heated inside the hot water tank 1350 is discharged out.

As described above, the hot and cold water dispenser according to the present invention can be applied to systems for supplying cold water or hot water as water for living or as drinking water.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A hot and cold water dispenser, which includes cooling means or heating means for cooling or heating water, the hot and cold water dispenser comprising:

a feed pipe having a flow path formed therein for allowing a flow of water; and a temperature control pipe disposed inside or outside of the feed pipe along a longitudinal direction of the feed pipe, the temperature control pipe having a space for receiving the cooling means or the heating means therein to cool or heat water flowing through the feed pipe by means of the cooling means or the heating means;

wherein the feed pipe has a pair of seating ribs protrudingly formed on an outer face thereof in the longitudinal direction of the feed pipe, a seating groove is formed between the seating ribs, and a temperature sensor is mounted on the seating ribs.

2. The hot and cold water dispenser according to claim 1, wherein the feed pipe is in a coiled form or in a linear form.

3. The hot and cold water dispenser according to claim 1, wherein the temperature control pipe is formed integrally with an inner circumferential surface or an outer circumferential surface of the feed pipe.

4. The hot and cold water dispenser according to claim 1, wherein at least two the temperature control pipes are reciprocatingly formed on an inner face or the outer face of the feed pipe.

5. The hot and cold water dispenser according to claim 1, wherein the feed pipe has a partition formed therein and at least one temperature control pipe is disposed at a center or both ends of the partition inside the feed pipe.

6. The hot and cold water dispenser according to claim 1, wherein at least two feed pipes are disposed, and the temperature control pipe is disposed on the outer faces of the feed pipes in such a way that all of the feed pipes are in contact with the temperature control pipe.

7. The hot and cold water dispenser according to claim 1, wherein the feed pipe is connected with a water purification filter for filtering water, and a converter is interposed between the water purification filter and the feed pipe.

8. The hot and cold water dispenser according to claim 1, further comprising a protection part disposed outside the feed pipe and the temperature control pipe.

9. The hot and cold water dispenser according to claim 1, further comprising a heat insulator disposed outside the feed pipe and the temperature control pipe.

10. The hot and cold water dispenser according to claim 8, wherein the protection part comprises heat transfer portions.

11. The hot and cold water dispenser according to claim 1, wherein a cold water tank comprises: first and second compartments that are opposed to each other, both ends of the first and second compartments being sealed, wherein the first compartment has a water inlet disposed at a first end thereof and the second compartment has a water outlet disposed at a first end thereof; and a pipe receiving portion disposed along a longitudinal direction of opposed faces of the first and second compartments, wherein the pipe receiving portion is spaced apart from second ends of the first and second compartments in such a way that the second ends of the first and second compartments communicate with each other.

12. The hot and cold water dispenser according to claim 11, further comprising:

a hot water tank; and a heater mounted inside the hot water tank for heating water introduced into the hot water tank, wherein the hot water tank comprises a temperature sensor, a water level sensor, and an air outlet, and the water level sensor and the air outlet are mounted on an upper portion of the hot water tank.

13. A hot and cold water dispenser, which includes a cold water tank and a refrigeration system, wherein the cold water tank has a pipe receiving portion formed therein, wherein a cooling pipe of the refrigeration system is disposed on the pipe receiving portion and mounted inside the cold water tank, and wherein the cold water tank comprises: first and second compartments that are opposed to each other, both ends of the first and second compartments being sealed, wherein the first compartment has a water inlet disposed at one end thereof and the second compartment has a water outlet disposed at one end thereof; and a pipe receiving portion disposed along a longitudinal direction of opposed faces of the first and second compartments, wherein another end of the first compartment and another end of the second compartment are connected with each other through a communication pipe outside the cold water tank.

* * * * *